US012667879B2

(12) United States Patent
Jurkovic et al.

(10) Patent No.: US 12,667,879 B2
(45) Date of Patent: Jun. 30, 2026

(54) DETERMINATION METHOD FOR DETERMINATION OF THE ROLLING OR GUIDING GAPS OF THE ROLL STANDS OR GUIDE STANDS IN A MULTI-STAND ROLLING MILL

(71) Applicant: SMS group GmbH, Mönchengladbach (DE)

(72) Inventors: Mirko Jurkovic, Mönchengladbach (DE); Helge Dähndel, Mönchengladbach (DE); Frank d'Hone, Mönchengladbach (DE)

(73) Assignee: SMS group GmbH, Mönchengladbach (DE)

( * ) Notice: Subject to any disclaimer, the term of this patent is extended or adjusted under 35 U.S.C. 154(b) by 328 days.

(21) Appl. No.: 18/213,353

(22) Filed: Jun. 23, 2023

(65) Prior Publication Data

US 2024/0001420 A1 Jan. 4, 2024

(30) Foreign Application Priority Data

Jul. 1, 2022 (DE) ..... 10 2022 116 502.7
Nov. 9, 2022 (DE) ..... 10 2022 129 593.1

(51) Int. Cl.
*B21B 38/10* (2006.01)
*B21B 31/20* (2006.01)
*B21B 37/58* (2006.01)

(52) U.S. Cl.
CPC ..... *B21B 38/105* (2013.01); *B21B 31/20* (2013.01); *B21B 37/58* (2013.01); *B21B 2271/02* (2013.01)

(58) Field of Classification Search
CPC ..... B21B 31/20; B21B 37/58; B21B 38/10; B21B 38/105; B21B 2271/02
See application file for complete search history.

(56) References Cited

U.S. PATENT DOCUMENTS 3,102,960 A * 9/1963 Sick ..... B21B 38/10 356/394
4,548,503 A * 10/1985 Liesch ..... B21B 38/00 356/621
4,821,544 A * 4/1989 Tamler ..... G01B 11/14 72/10.7
6,292,262 B1 * 9/2001 Ciani ..... G01B 11/14 72/21.1

(Continued)

FOREIGN PATENT DOCUMENTS

DE 37 24 982 A1 2/1989
DE 37 29 176 A1 3/1989

(Continued)

OTHER PUBLICATIONS

DE 102011078623A1, Denker et al. Jan. 2013.*
KR 20170073384A, Ryu et al. Jun. 2017.*

*Primary Examiner* — Edward T Tolan
(74) *Attorney, Agent, or Firm* — Collard & Roe, P.C.

(57) ABSTRACT

In order to be able to determine the rolling or guiding gaps of the roll stands or guide stands in a multi-stand rolling mill, at a predetermined measurement precision, with the least possible effort, a master calibration and intermediate calibrations are carried out, wherein various calibration measures are refrained from, in a targeted manner. The targeted lack of recourse in the case of specific calibrations is also independently advantageous.

31 Claims, 6 Drawing Sheets

(56) References Cited

U.S. PATENT DOCUMENTS

| | | | | |
|---|---|---|---|---|
| 7,320,237 | B2 * | 1/2008 | Kubota | B21C 51/00<br>72/10.7 |
| 10,286,434 | B2 * | 5/2019 | Haverkamp | B21B 31/16 |
| 2014/0216121 | A1 | 8/2014 | Haverkamp | |

FOREIGN PATENT DOCUMENTS

| | | | |
|---|---|---|---|
| EP | 1 679 137 | A1 | 7/2006 |
| EP | 2 590 761 | B1 | 9/2015 |
| JP | S57-121810 | A | 7/1982 |
| JP | S59-19030 | A | 1/1984 |
| JP | 2002-035834 | A | 2/2002 |
| SU | 668 142 | A1 | 6/1985 |
| WO | 2013/037350 | A2 | 3/2013 |

* cited by examiner

DETERMINATION METHOD FOR DETERMINATION OF THE ROLLING OR GUIDING GAPS OF THE ROLL STANDS OR GUIDE STANDS IN A MULTI-STAND ROLLING MILL

CROSS REFERENCE TO RELATED APPLICATIONS

Applicant claims priority under 35 U.S.C. § 119 of German Application No. 10 2022 116 502.7 filed Jul. 1, 2022 and German Application No. 10 2022 129 593.1 filed Nov. 9, 2022, the disclosures of which are incorporated by reference.

BACKGROUND OF THE INVENTION

1. Field of the Invention

The invention relates to a determination method for determination of the rolling or guiding gaps of the roll stands or guide stands in a multi-stand rolling mill.

2. Description of the Related Art

Multi-stand rolling mills are known, for example, from JP 57-121810 A and DE 37 24 982 A1 or SU 668 142 A, in which the rolling gap is supposed to be checked and optimized in accordance with the pass line of the rolling mill, in other words the center passage line of the rolling mill, as provided by the system. For this purpose, template bodies are clamped between the rolls of a roll stand and aligned by means of a laser system.

It is possible to do without clamping in the case of rolling mills as well as apparatuses and methods for determination of the rolling gaps of the roll stands in a multi-stand rolling mill according to JP 2002-035834 A or EP 1 679 137 A1, wherein a comparison scale and an illumination body must be affixed, in each instance, in the vicinity of the roll stand being measured, in each instance.

It is disadvantageous, in the case of these methods of procedure, that for this purpose a component or multiple components must be brought into the vicinity of the roll stands or rolls, in each instance, and this can be done only in a relatively complex manner, in particular in the case of roll stands or rolls arranged in the center of the rolling mill, which are difficult to access.

In contrast, the arrangements and methods of procedure according to JP 59-019030 A, in which a camera is provided at one of the input or output sides of the roll stand, and an illumination is provided at the other one of the input or output sides of the roll stand, or according to DE 37 29 176 A1, in which an illumination and camera are arranged on one of the input or output sides of the roll stand, and a reflector is arranged on the other one of the input or output sides of the roll stand, make do without components, wherein here, however, significant imaging inaccuracies must be accepted, in particular due to the significant lengths that such rolling mills have.

From EP 2 590 761 B1, for example, it is known that the rolling gap is measured inline, by a camera, with the inclusion of a reference sensor separately introduced into the rolling mill, wherein these reference sensors are newly installed in the rolling mill for each measurement, or, accordingly, significant imaging inaccuracies must be accepted.

SUMMARY OF THE INVENTION

It is the task of the present invention to determine rolling or guiding gaps at a predetermined measurement accuracy, with the least possible effort.

The task of the invention is accomplished by means of a determination method having the characteristics of the independent claims. Further advantageous embodiments, also independent of this, can be found in the dependent claims and in the following specification.

In order to determine rolling or guiding gaps at a predetermined measurement accuracy, with the least possible effort, a determination method for determination of the rolling or guiding gaps of the roll stands or guide stands in a multi-stand rolling mill, having a pass line that reaches through the roll stands or guide stands and serves as a reference for a gap offset, wherein first a camera is arranged at one of the input or output sides, and a background illumination is arranged, correspondingly, on the other one of the input or output sides, and subsequently the rolling or guiding gap of the stands is determined making use of an information technology device, wherein in a first step, the camera and the information technology device are calibrated offline and/or inline, with reference to the rolling mill, and wherein in a second step, the camera determines the rolling or guiding gaps inline, making use of the information technology device, can be characterized in that exclusively the gap form as a rolling or guiding gap is determined in the second step.

The roll stands preferably serve for supporting and setting the rolls, wherein the roll stands can then also absorb rolling forces during rolling.

In the present connection, the guide stands can preferably serve for guiding a workpiece to be rolled, wherein these can be arranged in front of or behind the roll stands. The guide stands can then guide the workpiece, for example, through the roll stands or between the roll stands, or on the input or output side, in the desired manner.

Because of the length of the workpieces to be rolled, of several meters, and for the best possible rolling result, preferably a multi-stand rolling mill is used, which comprises multiple such rolling or guide stands. Accordingly, the rolling mills can also have a significant length, wherein sufficient space must still remain on the input side and on the outside side, so that the workpieces can be conducted up and in or away.

In the present connection, the "pass line" can preferably be understood to be a center passage line of the rolling mill provided in accordance with the system, along which line the run-in or run-out, in particular, are also oriented, so that the workpieces can be brought in or up or brought away, at the correct height with reference to the roll or guide stands. In this regard, it must be taken into consideration, in particular, that the workpieces can have different diameters during introduction or removal, but in general are supported only on their underside, while in the region of the roll stands, rolls generally lie against the workpieces on all sides. A reference variable for the required settings is represented by the pass line defined for the rolling mill. This pass line can then be used as a reference for a gap offset.

It is advantageous if the "input side" describes the side of the rolling mill from which the workpiece gets into the rolling mill.

Accordingly, the "output side" can preferably be understood to be the side of the rolling mill from which the rolled workpiece leaves the rolling mill.

In the present connection, "background illumination" can preferably be understood to be a self-illuminating background that emits the most uniform illumination possible over its surface area. Ultimately, any device that is suitable for radiating through a number of roll or guide stands can be used as background illumination, so that a camera that is set up on its other side is able to take images through the roll and guide stands, in each instance, in which images the rolls or guides can be recognized accordingly as interruptions, to the extent that they interrupt the beam path of a light beam from the background illumination to the camera.

In the present connection, an "information technology device" can preferably be understood to be a unit that can take on information technology processing of all data required for the determination method. This device can comprise a storage unit for storing measured values. These measured values can relate, for example, to the arrangement of the rolls or the roll stands, so as to permit calibration. Also, the information technology device can preferably call up stored data once again. These data can then also be processed further or even output by the information technology device, so that stored measured values can be used, for example, so as to determine rolling or guiding gaps. The device therefore also represents a computing unit, for example, and preferably has corresponding interfaces, such as, for example, a monitor and a keyboard, and the like for communication with operating personnel and, for example, for controlling the roll stands or guide stands, so as to bring their rolls or guides into predefined positions, or to the camera. The information technology device is furthermore preferably able to undertake mathematical calculations, such as, for example, determining a factor, such as, for example, a pixel factor, from given scales, which factor in turn can be used for a corresponding calculation.

In the present connection, "offline," "inline," and "online" each describe specific states of the rolling mill.

Preferably "offline" describes the state in which at least one of the roll or guide stands of the rolling mill is not arranged in its operating position. Also, "offline" can describe the state in which the roll or guide stands of the rolling mill are not in their working position, in which they are during rolling. For example, the roll or guide stands of the rolling mill can be put into a maintenance space for maintenance purposes, wherein these can be arranged there, if necessary, as in the rolling mill, so that here, too, rolling or guiding gaps can be measured or determined, so as to then no longer have to carry out more corresponding measurements inline or online. Thus, in particular, the reactions and precise path distances that the rolls or guides travel when the corresponding setting elements are turned on, can be measured out, if necessary offline, significantly more precisely and with less time and work effort, over multiple test series and in small adjustment steps. In particular, the roll or guide stands can therefore be arranged not in the rolling mill. Offline, the roll stands can be arranged outside of the rolling mill, for example, so as to adjust or calibrate them in advance for a subsequent rolling process. In this regard, the possibility arises of adapting or changing the roll stands in the simplest possible manner, in terms of their positions, so as to undertake the optimal arrangement for the rolling process or for the calibration. In total, offline describes a state of the rolling mill not ready for operation, because, for example, important elements of the rolling mill are not set up or not in position. On the other hand, it is also conceivable to position roll and/or guide stands individually in the rolling mill, and them measuring them precisely, in detail, wherein the absence of adjacent roll or guide stands then facilitates access to the rolls or guides and the related stands, and thereby the corresponding measurements and checking them are correspondingly facilitated. In practice, this will surely be possible only in the case of time-intensive maintenance work, since otherwise the rolling mill would be blocked too long, due to determination of the rolling or guiding gaps.

In the present connection, accordingly, "inline" can be understood to be the state in which the rolling mill is ready for operation, with regard to the required equipment, and all the roll stands or guide stands are arranged in their working positions in the rolling mill. Also, the rolls of the roll stands can already be set with a rolling gap and/or the guides of the guide stands can be set with a guiding gap. In the inline state, there is generally no workpiece in the rolling mill, so that for example for a camera that is arranged on an output side or input side of the rolling mill, all the roll stands or all the rolls can be seen. Furthermore, the rolling mill has not yet reached an operating temperature inline, as a rule, so that it is not yet fully ready for operation inline. Possibly, in an inline state of the rolling mill, the feed or discharge of the workpieces is not yet ready for operation.

In contrast, an "online" state of the rolling mill can preferably be understood, in the present connection, to be the operating state or the state of the rolling mill ready for operation. In this state, a workpiece might actually be situated in the rolling mill. Furthermore, "online" can also preferably be described as the state in which the workpiece is rolled in the roll stands or in which the workpiece is guided by the guide stands. Online, the roll or guide stands can no longer be viewed, in specific operating situations, for example by a camera arranged at the input or output side of the rolling mill. Furthermore, the rolling mill is preferably also considered to be online when it is ready for operation and, for example, the required operating temperature is present in the rolling mill. It is conceivable, for example, that a short pause is present between individual rolling processes. During this pause, rolling does not take place, but the rolling mill is in a state ready for operation, during which further rolling could take place at any time. Specifically in these situations, a camera can then look through the roll or guide stands, in particular if, for example, a background illumination or camera are positioned for a short time, or if these or one of them are arranged outside of the movement spaces of the workpieces. In particular, sufficiently high operating temperatures are then still present, so that online can describe both a state during rolling and a state ready for operation.

In the present connection, the "rolling or guiding gaps" can be understood to be the geometrical setting with which the rolls or guides roll or guide a workpiece. In this regard, for example, the diameter or the shape and position of the diameter can be meant, which remains for the corresponding workpieces as they pass through the rolling mill, along the roll or guide stands. The rolls or guides accordingly form an inside diameter that represents the rolling or guiding gaps. It is understood that during rolling, deviations occur or can occur, in particular due to the elastic processes, but also due to plastic or non-elastic processes, because then the rolls, the guides, the related stands, and the workpiece are subject to significant forces.

In general, in measurement technology "calibration" can be understood to mean a measurement process for the determination and documentation of the deviation of a measurement device or a fundamental measurement standard as compared with another device or another fundamental measurement standard, which are referred to as a metrological standard in this case. In the present connection, the camera, together with the information technology device, represents a corresponding measurement device, and the rolling mill can, in the present case, preferably be understood to be a corresponding other fundamental measurement standard. Thereby, during calibration, the deviation of camera and information technology device is determined and documented as compared with the rolling mill, in particular as compared with the pass line of the rolling mill. It is also conceivable that the information technology device can be understood to be another device or as another fundamental measurement standard, if, for example, previously stored deviations or dimensional references are used for comparison during renewed calibration.

It is understood that the calibration of the camera and of the information technology device with reference to the rolling mill can or should take place, in particular, inline and/or offline, because online, a workpiece might be arranged in the pass line and therefore cannot be measured as such. On the other hand, it would be conceivable to carry out a corresponding calibration between two rolling processes or passes, as well as to carry out the related measurement processes, wherein this, however, appears to be so complicated that calibration between two passes would unnecessarily interrupt the rolls or could not be carried out with sufficient precision. Inline or offline, in contrast, no workpiece is situated in the rolling mill or on the pass line, and furthermore suitable ambient conditions are generally present or more time is available, so that in this regard, camera and information technology device can be calibrated to a sufficient degree with reference to the rolling mill.

Because the roll or guide stands are already arranged in the rolling mill inline in the same manner as they are also arranged during the actual rolling process online, it is advantageous if the camera determines the rolling or guiding gaps inline, in the second step, making use of the information technology device. In particular, possible position inaccuracies of the roll or guide stands can then be determined accordingly, in that, for example, unusual setting values for the setting of individual guides or rolls occur during the determination of the rolling or guiding gaps, or if unusual deviations of the rolling or guiding gaps are determined.

Preferably, for a good rolling result, a workpiece is rolled simultaneously by multiple rolls that are uniformly arranged around the workpiece. When the camera is looking along the pass line, two opposite rolls of a roll stand can then be seen, for example, which form a rolling gap with their rolling surfaces that stand in contact with the workpiece during rolling, i.e. apply rolling forces. In this regard, in particular with reference to the pass line or the workpieces that are passing through, for one thing the shape of the rolling gaps, in other words the gap shape, and for another thing its offset, in other words the gap offset, is of significance for the rolling result. In a similar manner, the shape and the offset of the guides, in other words here, too, the gap shape and the gap offset, are of significance, wherein ultimately, it is a geometric or vectorial task to break down the surface of the rolls and the guides that come into contact with the workpieces, in each instance, into a relative proportion of the surface to itself, on the one hand, in other words a gap shape, and into an absolute proportion, in other words the gap offset, which ultimately should lie on the pass line, for example, in the case of a suitable selection of the reference point, or should lie at an offset that deviates from this line, in a defined manner.

The gap shape and also the gap offset can be determined by way of the camera, making use of the information technology device. In this regard, however, it has turned out that the gap shape, which can ultimately be defined by the relative offset of individual surface points of the rolls or guides with regard to one another, already has a significant influence on the rolling result.

In the present connection, a "gap offset" can be understood to mean the offset of the gap produced by the rolls perpendicular to the pass line. If, for example, the center point of the rolling gap or of the gap is arranged precisely in the pass line, the gap offset is zero.

Thus, by means of a restriction to the gap shape that deviates from WO 2013/037350 A2 or from EP 1 679 137 A1, in the determination of the rolling or guiding gaps, deviation from an optimal or desired gap shape can be determined, and this, accordingly, then also serves for an improvement of the rolling result. Furthermore, this restriction has the advantage that the calibration does not have to take place so precisely in the first step, because in the second step, only the gap shape is determined, and specifically the rolling or guiding gaps are not yet determined, for which purpose a more precise calibration would be necessary in the first step. Accordingly, the measurement effort can be minimized by means of this restriction, and this minimizes the effort in terms of time, in particular, in this regard. To the extent, however, that a calibration with reference to the pass line can take place by means of less effort, for example in that the camera is merely brought to a specific position and only roughly oriented along the pass line toward the background illumination, the spatial effort can also be minimized, because for this calibration, an intervention in the region of the roll or guide stands does not have to take place, and the background illumination could possibly be arranged far away from the stands. This then leaves space for maintenance work, for example, in the region of the stands.

In order to determine rolling or guiding gaps at a predetermined measurement accuracy, with the least possible effort, cumulatively or alternatively, a determination method for determination of the rolling or guiding gaps of the roll stands or guide stands in a multi-stand rolling mill, having a pass line that reaches through the roll stands or guide stands and serves as a reference for a gap offset, wherein first a camera is arranged on one of the input or output sides and a background illumination is accordingly arranged on the other one of the input or output sides, and subsequently the rolling or guiding gap of the stands is determined making use of an information technology device, wherein in a first step, the camera and the information technology device are calibrated offline and/or inline with reference to the rolling mill, and wherein in a second step, the camera determines the rolling or guiding gaps inline, making use of the information technology device, can be characterized in that in the second step, exclusively the gap offset relative to a pass line that reaches through at least two rolling machines of a rolling mill comprising at least two rolling machines is determined as a rolling or guiding gap.

In the present connection, a "rolling machine" can preferably be understood to be any apparatus for rolling, wherein the rolling machine comprises all the components required for the rolling process. Different rolling methods can be carried out using a rolling machine. For example, a rolling machine could be a PQF rolling machine, which represents a seamless tube system, in which three-roll stands are used in interplay with a mandrel bar. A rolling machine can, however, also be an extracting mill for extracting finish-rolled pipes, preferably from another rolling machine. It is understood that sizing milling machines, plug rolling machines or cross-rolling machines, Assel rolling machines, piercing milling machines or other rolling machines, in particular rolling machines in which the rolling gap, contrary to the case in sheet milling machines, lies in two dimensions perpendicular to the rolling direction, approximately at the same scale, can be used as a place of use for the present invention. Thus the aforementioned rolling machines could also be combined and be part of a rolling mill. The rolling mill therefore describes a total system that can comprise several rolling machines.

Cumulatively or alternatively, a determination method for determination of the rolling or guiding gaps of the roll stands or guide stands in a multi-stand rolling mill, having a pass line that reaches through the roll stands or guide stands and serves as a reference for a gap offset, wherein first a camera is arranged on one of the input or output sides and a background illumination is accordingly arranged on the other one of the input or output sides, and subsequently the rolling or guiding gap of the stands is determined making use of an information technology device, wherein in a first step, the camera and the information technology device are calibrated offline and/or inline with reference to the rolling mill, and wherein in a second step, the camera determines the rolling or guiding gaps inline, making use of the information technology device, can be characterized in that in the information technology device, the roll stands or guide stands are referred to successively as a function along the pass line, and the information technology device comprises a measurement direction input possibility by way of which the placement of the camera on the input side and of the background illumination on the output side or vice versa and thereby the measurement direction can be input, so that possible measurement results can be assigned to each of the stands, independent of the measurement direction, by the information technology device, so as to determine rolling or guiding gaps with the least possible effort at a predetermined measurement accuracy.

In this way, the possibility arises that the calibration and the measurement of the rolling or guiding gaps can take place from both sides of the rolling mill, in a manner that is simple to use. The camera could therefore be arranged both on the input side and on the output side, for a calibration and measurement, and the background illumination can be arranged on the other side, accordingly. This flexible measurement and calibration possibility proves to be advantageous, for example, if work is being performed in the region of one of the sides of the rolling mill or one of the regions is not accessible for some other reason. In particular, in certain constellations the camera might have to be arranged at a sufficient great distance from the rolling mill for an operationally reliable and precise measurement. If this space happens not to be available on the input side at a certain time, the camera could therefore also be arranged on the output side, and the background illumination on the input side, so that the measurement direction of the camera is from the output side to the input side.

Accordingly, by means of this measure the spatial effort for the measurements can be limited to a minimum, in that regions of the rolling mill are not impaired by these measurements, so that maintenance work can be carried out here.

In this connection, it should be emphasized that the determination of rolling or guiding gaps as such should take as little time as possible, because as long as measurements are carried out offline or inline, in other words not online, the rolling mill is not in operation and therefore the corresponding time frame must be evaluated as downtime. Therefore, if corresponding measurements can be carried out during maintenance work that is necessary anyway, this directly results in a corresponding reduction or minimization of downtimes.

The measurement direction is preferably defined, in the present connection, as the direction from the camera to the background illumination.

It is advantageous if in the information technology device, the roll stands or guide stands are designated successively as a function of the rolling direction, so as to be able to assign the designations even more easily to the input and output side, because in the present connection, the rolling direction preferably points from the input side in the direction of the output side, and ultimately also shows the direction and sequence in which the roll or guide stands as well as their rolls or guides act on the workpiece passing through them for the machine operator.

Accordingly, it is advantageous if the measurement image is imaged or can be imaged in the information technology device. If the calibration and the measurement of the rolling or guiding gaps take place from the other side of the rolling mill, the measurement image can simply be mirrored once, so as to obtain the same measurement image that would have been measured from the other side of the rolling mill, in each instance.

Cumulatively or alternatively, a determination method for determination of the rolling or guiding gaps of the roll stands or guide stands in a multi-stand rolling mill having a pass line that reaches through the roll stands or guide stands and serves as a reference for a gap offset, wherein first a camera is arranged at one of the input or output sides, and a background illumination is arranged on the other one of the input or output sides, accordingly, and subsequently the rolling or guiding gap of the stands is determined making use of an information technology device, wherein in a first step, the camera and the information technology device are calibrated offline and/or inline with reference to the rolling mill, and wherein in a second step the camera determines the rolling or guiding gaps inline, making use of the information technology device, can be characterized in that in the first step, a first reference sensor and a second reference sensor are arranged in the pass line, subsequently the position of the camera and/or of a target is/are changed in such a manner that the two reference sensors and, if applicable, also the target are separately detected by the camera.

Separate detection guarantees that the reference sensors can be detected simultaneously, in their entirety, by the camera, so that both reference sensors can be detected at the same time, completely, in one image of the camera. From this image, the offset of the camera with reference to the pass line, for example, can then be determined, by way of the reference sensors, for example, so that subsequently, corresponding measurements can be carried out. In that the two reference sensors are detected completely and preferably separately, in each instance, in the image, it is possible to search for the corresponding shapes by means of a simple image evaluation, and then these can also be determined very reliably.

Ultimately, any device with which the orientation of a camera with reference to the pass line and/or a pixel factor or some other reference measurement can be determined, can serve as a reference sensor. In particular, such reference sensors can be specific reference points that are arranged at established positions with reference to the pass line. Because such reference points are, however, generally difficult to recognize by a camera, because rolling machines as such represent a relatively stressed environment, it is advantageous if the reference sensors, as independent structures, can be affixed at corresponding positions and also can be removed again. This can happen, for example, in that corresponding screw holes or the like, are provided, by means of which reference sensors can then be positioned accordingly, wherein the screw holes can then be protected by means of covers during rolling, for example. On the other hand, in particular if measurements are not carried out very precisely, the related stands can serve as reference sensor rolls, guides, wherein then, corresponding structures can be accordingly determined or searched for in a targeted manner, by means of an image evaluation of the images detected by the camera, so as to be able to determine the corresponding offset from the pass line or the pixel factor or some other reference dimension. Depending on the concrete requirements, a specially configured reference stand can also serve as a reference sensor.

It is understood that in the case of alternative methods of procedure, the reference sensors can also be detected successively, in that first, for example, rolls or guides of a first stand and then rolls or guides of a stand at a distance from the first are moved to predefined positions, and corresponding images are recorded, in each instance. In this manner, overlaps that make an image evaluation more difficult or interrupt the beam path of the background illumination to the camera in such a manner that rolls or guides that are actually to be used, or other modules, cannot be detected by the camera, are avoided. On the other hand, the image evaluation is then somewhat more complex, and multiple images must be recorded so as to be able to detect at least one reference sensor close to the camera and one reference sensor away from the camera.

Preferably, in particular if calibration rings are provided, the reference sensors are configured in such a manner that the camera is oriented in such a manner that one of the reference sensors, in particular the reference sensor close to the camera, surrounds the other one, in other words then, in particular the reference sensor away from the camera. By means of the separate detection, a good image evaluation can then be guaranteed, while for the remainder, the reference sensors can be selected to be as large as possible, and this brings advantages with it with regard to measurement accuracy.

In the present connection, a "calibration ring" can preferably be understood to mean a rigid body that is configured in the manner of a ring, in other words encloses a simply cohesive area. Preferably the calibration ring is configured to be circular, and thereby represents a rigid, circular frame, so that also, corresponding to the simple geometrical structure, a simple evaluation appears possible in the information technology device. It is advantageous if this ring is also configured to be open in the interior, so that it is possible to look through the calibration ring.

In the present case, the calibration ring can be used as a reference sensor. In this regard, the calibration ring can be both a reference sensor close to the camera and a reference sensor away from the camera. Also, it is conceivable that the calibration ring can be used as a master reference for a possible master calibration.

When using a calibration ring as a reference sensor, a plurality of orientation points along the ring can be detected by the camera. As a result, the camera can detect the position and dimensioning of the calibration ring very precisely, and thereby also determine the center point of the calibration ring. Along the precisely determined center point, the pass line can be defined precisely or the offset from it can be determined precisely. Proceeding from this, a very precise calibration can then take place by way of the calibration ring. Other geometrical data, as well, such as, for example, a pixel factor, can be detected very precisely by way of a calibration ring, in particular if this ring is configured to be circular, and evaluated using data technology.

It is advantageous if the first calibration ring can serve as the first master reference and the second calibration ring can serve as the second master reference, because very precise calibration is possible by way of the calibration rings, and thereby a very precise master calibration can also take place. In this regard, it is conceivable, in particular, that measures can be provided, by means of which the calibration ring can be mounted, in a relatively simple manner, at an identical position, in each instance. In this regard, for example, drilled holes for holding arms can be provided, for example, which holes can be covered during rolling.

In order to be able to pre-adjust the camera as quickly and easily as possible, and also as precisely as possible, at the same time in the pass line, the first calibration ring preferably comprises at least two reference arms or the second calibration ring comprises at least two reference arms. In particular, the two calibration rings can have corresponding reference arms.

It is conceivable that, in particular for a rough pre-adjustment of the camera in the first step, a first and a second reference sensor, having at least three, preferably four reference arms directed at a central reference point are arranged in the pass line, wherein the second reference sensor is arranged, relative to the first reference sensor, offset by an angle, so that the two reference sensors are oriented differently, and subsequently the position of the camera is changed in such a manner that the two reference sensors lie in the center of a target formed by the camera, and thereupon the center of the background illumination is moved into the center of the target.

The reference arms can serve, in particular, to allow a machine operator or other operating personnel to obtain an approximate idea regarding the position of the pass line. For this purpose, the reference arms can meet or intersect, for example, at or close to the pass line.

In order to precisely define the camera and the information technology device with reference to the rolling mill, references are preferably used, so that the respective positions of the rolls or guides and thereby the rolling or guiding gaps can be determined properly, according to scale, accordingly. In the present case, the reference can be configured as a reference sensor or gap ring, which represents a mechanical element that serves as a reference. The reference sensor can be configured, for example, as a rigid frame having a circular basic shape. However, other configurations are also conceivable, such as, for example, rectangular frames or configurations that deviate from a frame.

The reference sensor or the calibration ring preferably comprises multiple reference arms that are arranged on the reference sensor. In the present connection, a "reference arm" can preferably be understood to be a long, narrow and rigid body. However, the reference arm can also be configured in some other way. The multiple reference arms are then preferably attached to the reference sensor or calibration ring in such a manner that they are oriented toward a central reference point. In the present connection, the "reference point" can therefore be understood to mean the point toward which all the reference arms are jointly oriented. In this regard, the reference arms can also touch in a region around the reference point. It is advantageous, in particular, if all the reference arms touch precisely at the reference point. However, all other embodiments of the reference arms are possible, which can define an established reference point.

It can be sufficient if the reference sensor or calibration ring is provided with two reference arms, wherein each of the reference arms is configured to be long and narrow, and the two reference arms touch at a point or the two reference arms appear to intersect at a reference point from the point of view of the camera, along the pass line. In this regard, the impression can merely occur that the two reference arms intersect, even if they are possibly arranged one behind the other and actually do not touch. Due to the perspective of the camera, however, an image occurs of two reference arms that intersect at the reference point.

In the present connection, the "target" can be understood to mean, in particular, a body arranged in front of the background illumination or also a shielding or non-luminous region of the background illumination, by means of which the camera is oriented with reference to the pass line or by means of which the orientation of the camera with reference to the pass line and thereby the currently present offset can be determined.

The target can preferably be used as an aid for the purpose of determining the current orientation of the camera with reference to the pass line, during the actual measurements of the rolling or guiding gaps, in particular if, for example, building vibrations lead to a slight angle offset of the camera, which could then lead to a significant measurement error in the case of the long path distances between the camera and the rolls or guides.

It is understood that the target can fundamentally be arranged at any location in the pass line in the viewing field of the camera, such as, for example, between the camera and a reference close to the camera. In the sense of great measuring accuracy and the least possible impairment of possible maintenance work on the rolling machine, it appears to be advantageous to arrange the target on the side of the rolling machine away from the camera. In particular, it is advantageous to arrange the target in the immediate vicinity of or on the background illumination, so that no and only insignificantly more space is taken up for this purpose.

Preferably, the target is round or configured as a circular disk or circular ring. This makes it possible to obtain the greatest possible measurement accuracy, as was already explained above with reference to the reference sensors or calibration rings.

In this regard, the target can be arranged by means of alignment of the camera and by means of a suitable selection of size, in particular within the calibration rings, so that the calibration ring close to the camera surrounds the calibration ring away from the camera separately, and the latter surrounds the target separately. This makes it possible that all of these modules can be detected by the camera in one image. Afterward, the reference sensors can be removed and the measurements can be carried out, wherein an angle offset of the camera can be calculated, in each instance, by way of the target.

For reasons of measurement accuracy, the target is selected to be as large as possible, as long as it remains visible for the camera, in an operationally reliable manner, within all the gaps, in other words the rolling gaps or guide gaps to be measured, so as to fulfill its function of calculating a possible angle offset of the camera. Also, for this reason the target should be selected to be smaller than the reference sensors or calibration rings.

It is advantageous if the reference arms of a first reference sensor or calibration ring are not arranged precisely like the reference arms of a second reference sensor or calibration ring. In particular, it is advantageous if the angle offset is not equal to a symmetry of the arrangement of the reference arms. Then very precise adjustment is possible, because for the camera, the reference arms of the first reference sensor or calibration ring and the reference arms of the second reference sensor or calibration ring can be distinguished more clearly. Therefore the two reference points can also be recognized more precisely and thereby can be adjusted to be significantly more precisely in the center of the target.

Preferably, the second reference sensor or calibration ring is arranged offset by an acute angle relative to the first reference sensor or calibration ring, so that the two cruciform reference sensors or calibration rings are oriented differently. This helps to orient or pre-position the camera, relative to the two reference sensors or calibration rings, as easily and precisely as possible, along the pass line.

An acute angle preferably describes an angle less than 90°. In this way, it is prevented that two reference sensors, each having four reference arms, each oriented the same way, are arranged offset by an angle of 90°. In the case of an angle-offset arrangement of 90°, the reference sensors would once again be oriented the same way and specifically not differently. However, in order to be able to detect the two reference sensors precisely when looking at the reference sensors through the camera, along the pass line, it is advantageous if they are specifically oriented differently. In the case of reference sensors that are oriented in the same way, the rear one of the two reference sensors, from the point of view of the camera, might not be detected by the camera, because the reference sensor closer to the camera could cover up the view of the reference sensor that is farther away.

Four reference arms result in a particularly good and precise adjustment possibility of the two reference sensors or calibration rings, so that the simplest possible and fast but nevertheless quite precise pre-adjustment of the camera can take place. For this reason, it is advantageous if the reference arms of at least one of the two reference sensors or calibration rings are arranged in cross shape. If the reference sensor or calibration ring comprises four reference arms, a cruciform arrangement of the reference arms is advantageous, so that these are arranged uniformly or in a specific symmetry relative to one another. For example, all the reference arms could then form a 90° angle relative to their adjacent reference arms. However, it is also conceivable that the angles of the reference arms that lie opposite one another, in each instance, are the same, but not equal to 90°. For example, two angles that lie opposite one another can each be 70°, and the two other opposite angles can each be 110°. It is understood that all other arrangements of the reference arms relative to one another, deviating from this, are also possible.

Preferably, reference arms of both reference sensors or calibration rings are arranged in cross shape, because an even better and precise adjustment possibility can be achieved if not just one of the two reference sensors or calibration rings but rather both of them are structured accordingly.

Preferably, the calibration of the camera and of the information technology device takes place, in the first step, by means of at least one reference close to the camera and at least one reference away from the camera, which are arranged, in each instance, not between the rolls or guides of the first of the stands and the rolls or guides of the last of the stands. In this way, the selection of the reference sensors for the calibration in the first step is flexible, so that no reference sensors of any kind are necessary between the rolls or guides of the first of the stands and the rolls or guides of the last of the stands. For example, the calibration rings could be, in each instance, the reference close to the camera and the reference away from the camera. Likewise, it is conceivable that the reference close to the camera and the reference away from the camera are the master references.

This furthermore offers the advantage that a calibration of the camera and of the information technology device can take place as quickly as possible, without separate reference sensors, for example, having to be introduced into the rolling mill in the region between the first and the last of the stands. In this regard, it must be taken into consideration that rolling mills are relatively large and, due to the fact that a plurality of stands might be arranged very tightly one behind the other, the regions between the first and last stand are only accessible with very great difficulty, because a plurality of ancillary units is also arranged around the rolls and guides. Furthermore, in the surroundings of rolling mills, very difficult ambient conditions prevail, so that as a rule, background illumination and camera as well as other more delicate measurement devices are removed during rolling, so that they are not impaired or the work is not hindered.

Accordingly, in this way, the effort in terms of time for the corresponding measurements can be further minimized, because the measurements can be carried out without having to get in between the stands, with great effort.

In order to determine rolling or guiding gaps at a predetermined measurement accuracy, with the least possible effort, cumulatively or alternatively a determination method for determination of the rolling or guiding gaps of the roll stands or guide stands in a multi-stand rolling mill having a pass line that reaches through the roll stands or guide stands and serves as a reference for a gap offset, wherein first a camera is arranged at one of the input or output sides, and a background illumination is arranged accordingly, on the other one of the input or output sides, and subsequently the rolling or guiding gap of the stands is determined, making use of an information technology device, wherein in a first step, the camera and the information technology device are calibrated offline and/or inline with reference to the rolling mill, by means of at least one reference sensor close to the camera and at least one reference sensor away from the camera, which are arranged, in each instance, not between the rolls or guides of the first of the stands and the rolls or guides of the last of the stands, wherein in a second step, the camera determines the rolling or guiding gaps inline, making use of the information technology device, can be characterized in that before the calibration corresponding to the first step, first the camera is arranged on a reference holder, in a previously defined reference position, and the reference sensor close to the camera and the reference sensor away from the camera are arranged in previously defined reference positions, and then, for the calibration corresponding to the first step, the reference sensor close to the camera and the reference sensor away from the camera are measured by means of the camera and the information technology device, and subsequently, the pass line or the offset from the pass line are determined from the measurement result. This method of procedure makes it possible, in particular, to then later determine the offset of the measured gaps, even in the case of very long rolling machines, with relatively great precision, in particular if it can be ensured, by means of a target, that possible fluctuations or a possible angle offset of the camera can be calculated by means of knowledge of the previously determined offset.

Cumulatively or alternatively, a determination method for determination of the rolling or guiding gaps of the roll stands or guide stands in a multi-stand rolling mill having a pass line that reaches through the roll stands or guide stands and serves as a reference for a gap offset, wherein first a camera is arranged at one of the input or output sides, and a background illumination is arranged on the other one of the input or output sides, accordingly, and subsequently the rolling or guiding gap of the stands is determined making use of an information technology device, wherein in a first step, the camera and the information technology device are calibrated offline and/or inline with reference to the rolling mill, by means of at least one reference sensor close to the camera and at least one reference sensor away from the camera, which are arranged, in each instance, not between the rolls or guides of the first of the stands and the rolls or guides of the last of the stands, and wherein in a second step the camera determines the rolling or guiding gaps inline, making use of the information technology device, can be characterized in that before the calibration that corresponds to the first step, first the camera is arranged on a reference holder in a previously defined reference position, and the reference sensor close to the camera as well as the reference sensor away from the camera are arranged in previously defined reference positions, and then, for the calibration that corresponds to the first step, the reference sensor close to the camera as well as the reference sensor away from the camera are measured by means of the camera and the information technology device, and subsequently, a pixel factor is determined from the measurement result.

If the method is managed appropriately, in this way the calibration takes place fairly rapidly and without overly great spatial effort, in particular on the side away from the camera.

The reference sensor away from the camera and the reference sensor close to the camera can already be suitable arranged if certain edges or corners of roll stands are used as references. Thus, the rolls or guides can be set accordingly, if measurements are supposed to take place by way of their positions. It is conceivable that the calibration rings or reference sensors can also be used for the present determination method, and are arranged accordingly. In particular, corners or edges of the stands, for example of the last and of the first stand, could also be used as a reference close to the camera or away from the camera.

In the present connection, the term "pixel factor" describes any reference dimension with which a spatial distance is imaged by the camera at a defined height of the camera, along the pass line. Ultimately, this is a factor by means of which the number of pixels that image this spatial distance can be converted to a common distance statement, for example in cm, inches or m. It is understood that instead of the camera pixel, a different distance, for example the distance between two points on a monitor, can also be selected as a basis, wherein pixels have the advantage that they can be precisely and unambiguously assigned to the corresponding camera, independent of other devices. At a specific distance of a reference sensor or another object, such as the rolls or guides, to the camera, the related pixel factor can be used, proceeding from the number of pixels between two points of an image taken by the camera, to determine the distance of the body shown in the image, taking into consideration the pixel factor. By its nature, the pixel factor changes with the height to the camera along the pass line, as long as the camera has a focal width or a finite depth of focus. Vice versa, if a distance, such as, for example, the diameter of the calibration ring, is known at a reference sensor, such as, for example, at a calibration ring, the pixel factor can be determined quickly and precisely, in that the number of pixels that image the diameter is put into a ratio with the actual diameter. In this regard, the pixel factor offers a possibility, in the simplest possible manner, of calibrating the camera relative to the references. It is advantageous that the pixel factor can advantageously be just a number that is used for calculating the actual pixel count at a specific distance. Accordingly, the pixel factor is merely a mathematical variable, and just not an objective object, in contrast to a reference scale, which represents an objective object for indicating a scale and can be set up for determination of the pixel factor in defined positions along the pass line. In particular, the reference sensors can be used as reference scales if distances such as radii, diameters or the like are known there.

If necessary, the pixel factor can also be extrapolated if it is sufficient, for reasons of accuracy, to do without measurements at specific heights along the pass line by way of beam sets.

In particular, a pixel factor can be recorded at a height along the pass line, in each instance, in two directions that run perpendicular to the pass line, in each instance, and do not extend orthogonally, so as to detect possible inaccuracies in the optics or to detect anisotropisms of the camera. On the other hand, if the camera has the pixels in all directions at the same distance, and corresponding inaccuracies of the optics play a subordinate role, the measuring accuracy could also be increased by means of corresponding measurements along different directions.

The calibration takes place, in particular for this reason, quickly and easily if previously defined reference positions or previously measured pixel factors can be used, and thereby are made available directly by means of the information technology device. They therefore do not have to first be determined in another manner, ahead of the actual gap measurement. From the prior art, such as, for example, from EP 2 590 761 B1, it is known that comparison scales are arranged somewhere in the rolling mill, from which the reference scales can then be determined. However, these must be affixed in the rolling mill at some point in time, and must also be looked at or measured for the calibration, so as to determine the reference scales.

Any objective dimension, for example a centimeter ruler or a known distance between two points, can be used as a reference scale, by means of which it can be determined, at a specific height along the pass line, what precise distance two points actually have, which occur as pixels or a group of pixels in the camera. This makes it possible to master optical effects that can occur, for example, in the case of long optical paths between the background illumination or the stands and the camera, with regard to the dimensional accuracy with which distances can be measured in a specific plane perpendicular to the pass line, by means of the camera, and to calculate them by means of suitable mathematical transformations. This holds true, in particular, if a telecentric lens is eliminated, so that, for example, an expanded beam path through the stands must be taken into consideration, which path then leads to the result that two pixels in the camera, which measure the distance between two modules in the first of the roll or guide stands, represent a smaller distance than when they measure the distance between two modules in the last of the roll or guide stands.

By means of the access to reference positions or a pixel factor stored in the memory of the information technology device, it is then possible, in particular in distinction from WO 2013/037350 A2, to carry out the calibration that corresponds to the first step, significantly more quickly and without needing objective reference scales that must actually be affixed and detected by the camera.

Since reference sensors arranged in the rolling mill as well as other elements of the rolling mill, as already explained above, can appear to have different sizes for a camera, by its nature, although they have the same size, for example, reference scales that describe the optical distortion based on the viewing angle of the camera as well as the arrangement are preferably made available, so that the images determined by way of the camera can be evaluated in accordance with the standards, by way of the information technology device, and all the measured variables can accordingly be converted to a pixel factor.

In the present connection, a "reference offset" can preferably be understood to mean the distance of reference sensors from the pass line. The reference offset can also be the gap offset, if rolls or guides are used as reference sensors close to the camera or away from the camera.

In order to determine rolling or guiding gaps at a predetermined measurement accuracy, with the least possible effort, cumulatively or alternatively a determination method for determination of the rolling or guiding gaps of the roll stands or guide stands in a multi-stand rolling mill, having a pass line that reaches through the roll stands or guide stands and serves as a reference for a gap offset, wherein first, a camera is arranged on one of the input or output sides, and a background illumination is accordingly arranged on the other one of the input or output sides, and subsequently the rolling or guiding gaps of the stands are determined, making use of an information technology device, wherein in a first step, the camera and the information technology device are calibrated offline and/or inline with reference to the rolling mill, by means of at least one reference sensor close to the camera and at least one reference sensor away from the camera, which are arranged, in each instance, not between the rolls or guides of the first of the stands and the rolls or guides of the last of the stands, wherein in a second step, the camera determines the rolling or guiding gaps inline, making use of the information technology device, can be characterized in that the reference sensor close to the camera and the reference sensor away from the camera are coordinated with one another and with reference to the camera, in such a manner that both can be simultaneously detected by the camera. This makes it possible that only a single image needs to be evaluated, so as to determine, for example, the pixel factors that belong to the respective reference sensors and their positions, or also the corresponding reference offset from the pass line.

In particular, it is advantageous if the reference sensor close to the camera and reference sensor away from the camera are coordinated with reference to the camera and with its lens, since the lens of the camera is the means of the camera that detects the reference sensors as such. It is also determined by way of the lens of the camera in what range the camera can see with good focus and thereby can still detect the references with good focus. For example, in order to be able to set the lack of focus or the focus of the two references to be the same, it is advantageous if the camera can detect both reference sensors. Naturally, this might already be the case if the reference sensor close to the camera and the reference sensor away from the camera are configured to have the same size, because then the reference away from the camera appears to be smaller, from the point of view of the camera, and therefore might be detectable from the camera perspective. If, however, very great focal widths or very great focal depths are used, which requires a great distance of the camera from the stands, and, in particular, also from the reference sensors, this might not be sufficient. It is understood that then the reference sensor close to the camera and reference sensor away from the camera can also be configured to have different sizes, so that they can nevertheless be detected simultaneously by the camera. In this regard, the detectability depends, for example, on the distance of the camera from the reference sensors, on the distances of the reference sensors from one another, or on the actual size of the two reference sensors. By way of simple mathematical relationships, sizes and arrangements of the reference sensors can therefore be determined, in which the two reference sensors can still be simultaneously detected by the camera.

In the present connection, a "lens" can preferably be understood to be a collecting optical system that generates a real optical image of an item or object. It is the most important component of imaging optical devices, for example of cameras, binoculars, microscopes, projectors or astronomical telescopes. Because therefore the lens also represents the most important component of the camera of the present invention and assures the actual optical image, it should be possible to detect the two reference sensors by way of the camera and the related lens.

It is conceivable that for different measurement tasks, for example for rolling machines having different lengths, different lenses are also used, so that, in particular without adjusting the focal width, at a suitably selected distance of the camera from the rolling machine, a change in the focal width, which would ultimately reduce the precision of the measurement result, can be omitted.

Cumulatively or alternatively, a determination method for determination of the rolling or guiding gaps of the roll stands or guide stands in a multi-stand rolling mill, having a pass line that reaches through the roll stands or guide stands and serves as a reference for a gap offset, wherein first, a camera is arranged at one of the input or output sides, and a background illumination is accordingly arranged on the other of the input or output sides, and subsequently the rolling or guiding gaps of the stands are determined, making use of a information technology device, wherein in a first step, the camera and the information technology device are calibrated offline and/or inline, with reference to the rolling mill, by means of at least one reference sensor close to the camera and at least one reference sensor away from the camera, which are arranged, in each instance, not between the rolls or guides of the first of the stands and the rolls or guides of the last of the stands, wherein in a second step, the camera determines the rolling or guiding gaps inline, making use of the information technology device, can be characterized in that before the calibration that corresponds to the first step, the camera is arranged on a reference bracket, in a previously defined reference position, and subsequently a lens of the camera is repositioned, in terms of its focus, until the reference sensor close to the camera and the reference sensor away from the camera are imaged with an almost identical lack of focus, so as to determine rolling or guiding gaps at a predetermined measurement accuracy, with the least possible effort. Such a method of procedure makes it possible, if the method is suitably carried out otherwise, to calibrate the camera rapidly and to subsequently perform the measurement. In particular, further calibration can be eliminated, because the optics of the camera do not have to undergo any changes. The depth of focus can be selected in such a manner, by way of the distance of the camera and the selection of a suitable focal width, that the desired measurement accuracy can be ensured, in an operationally reliable manner, over the entire rolling machine.

In the present connection, "reference bracket" can preferably be understood to mean a mechanical holder for holding a camera, for example, and/or a reference sensor, wherein it is advantageous if the reference bracket can be arranged precisely in a specific position or the precise position can be determined, in particular, with reference to the pass line, the stands or other elements of the rolling mill, and the position that the object arranged in the holder assumes can then be correspondingly referred to as a reference position.

In particular, the reference bracket is preferably arranged in such a manner that it is not disruptive, even in the online state of the rolling mill, and ultimately can remain in its position even during rolling. Slight cleaning work might have to be undertaken so as to arrange the camera in its reference position in as operationally reliable a manner as possible, for example if abraded material, dust, and other contaminants settle there. In general, the reference bracket of the camera will preferably be arranged relatively far away from the roll or guide stands, in particular if a telecentric lens is omitted, so that the degree of contamination is kept within limits.

The focus positioning of the lens of the camera as described above, so as to image the references with an almost identical lack of focus, serves for allowing the camera to cover the entire region of the rolling mill between the first and the last roll or guide stand, in the best possible manner, without the focus having to be changed during the measurements. Because a camera, by its nature, can only image a specific region with sharp focus and can image specific regions that go beyond this with a lack of focus, it is recommended that the focus of the camera lies between the two references or between the first and the last of the roll or guide stands, ideally sufficiently precisely in the center between the two references, so that the lack of focus is minimized over all of the roll or guide stands. In this case, the two references are imaged with an almost identical lack of focus. In deviation from WO 2013/037350 A2, in this way it is possible to do without refocusing, which might lead to undesirable repositionings, caused by repositioning of the lens with reference to the image-recording components of the camera. Also, no time for refocusing needs to be planned. Accordingly, a corresponding measurement imprecision, which results from the lack of focus, is taken into account in favor of doing without refocusing, wherein, in particular if no telecentric lens is supposed to be used, the distance between the camera and the roll or guide stands might possibly be selected to be greater, so as to be able to keep the lack of focus, which has been accepted, within desired limits.

In the present connection, as well, rolls or guides or modules of the roll or guide stands might be used as reference sensors.

Preferably, the reference sensor close to the camera and/or the reference sensor away from the camera is/are one of the rolls. In a rolling mill, rolls are required for the rolling process in any case, so that at least inline, corresponding rolls are also present in the rolling mill. Since these are present as a possible reference point in any case, they could also be used as a reference sensor close to the camera or away from the camera. Because furthermore, a multi-stand rolling mill also has multiple rolls, a roll that is as close to the camera as possible can be used as a reference close to the camera, and a roll that is somewhat further away, or the farthest away from the camera, can be used as a reference away from the camera. It is understood that multiple rolls of a roll stand could also be used accordingly. The roll stands extend over a large region of the rolling mill, so that the possibility also exists that the region between a reference sensor close to the camera and one away from the camera can be as large as possible. Also, numerous rolls are available as possible reference sensors, so that possibly, the rolls that are particularly suitable for use as a reference sensor close to the camera or away from the camera, for example because the camera is able to look at them, can also be selected as reference sensors. In particular, rolls are particularly suitable as a reference sensor close to the camera, if the camera is arranged on the input side of the rolling mill, because the roll stands are generally arranged on the input side of the rolling mill, in the rolling direction, and therefore rolls are also arranged very close to the camera. Thus, a roll that is also arranged relatively close to the camera can be selected as a reference sensor close to the camera.

It is advantageous if the reference sensor close to the camera and/or the reference sensor away from the camera is/are one of the guides, because the guides, as well, are part of the rolling mill, in case of doubt, in any case, and therefore can represent a fixed mechanical reference. Because multiple guides are frequently present over a greater region, reference sensors close to the camera and away from the camera can also be guides. In the case of a possible arrangement of the camera on the input side of the rolling mill, a guide can, in particular, be used as a reference away from the camera, because in the rolling direction, the guides are arranged behind the rolls, in other words closer to the output side of the rolling mill. In this way, the greatest possible region of the rolling mill could be detected with a guide as a reference away from the camera, with the references that are selected then.

As explained in connection with the embodiments described above, one of the roll or guide stands could also be a reference sensor close to the camera and/or away from the camera.

It is also conceivable that the reference close to the camera or away from the camera is a reference stand, because a reference stand is inserted in any case, when references are used, and installed in the rolling mill in a fixed position.

In the present connection, a "reference stand" can preferably be understood to be a mechanical stand, on which reference sensors can be or are affixed or firmly mounted in place. In this regard, it might be advantageous if the reference stand specifically has installation aids adapted to the respective reference sensors, so that the references can be affixed, as precisely as possible, in a specific position, in the simplest possible manner. Reference sensors that are arranged on the reference stand can be, for example, calibration rings, reference sensors, master references, or references close to the camera or away from the camera.

For the greatest possible precision during calibration, separate reference sensors can also be used as reference sensors close to the camera and/or away from the camera, as has already been explained above. It is true that these must be introduced separately at the given point in time, and they might not be made available by the rolling mill per se, but they can have, for example, greater precision or, for example, reference arms for representing the pass line, and also can be arranged accordingly, so that they can be viewed very well by the camera. Depending on the configuration of the reference sensors, they can also be suitably arranged or configured for orientation along the pass line. In particular, however, the reference sensors can be modules of the roll or guide stands, such as, for example, previously determined corners or edges. Preferably, these reference sensors lie on modules of the roll or guide stands, which can be repositioned jointly with the guides or rolls, so that the respective reference sensors can be introduced, in the desired manner, into the optical path from the camera to the background illumination.

If the reference sensors close to the camera or away from the camera are some other reference sensor, it is advantageous if the reference sensor is brought into a reference position, because these reference positions are defined in advance, and the reference sensor can thereby be arranged at the defined position, so that the most precise calibration possible can take place. In particular, the reference sensor can be removed again after a corresponding measurement, so that viewed from the direction of the camera, for example, reference sensors that lie behind it can be optically detected, or they do not hinder the rolling process or cannot be impaired by it. Likewise, it is conceivable that a calibration ring is used as a corresponding reference sensor, so that preferably, the calibration ring can also be brought into a reference position.

Furthermore, it is advantageous if the reference stand is also brought into a reference position, so as to achieve the same advantages.

It is advantageous that the rolls or guides of the first and of the last of the stands is brought into a reference position, and these or correspondingly moved modules of the stands, such as, for example, positioning bodies or supports, are used as a reference close to the camera or away from the camera. In this regard, the rolls or guides of the first and of the last of the stands, in particular, prove to be particularly advantageous, because in this way, a reference as close as possible to the camera and a reference as far away from the camera as possible, in the form of a roll or a guide, can be used, because the first and last of the stands are arranged, accordingly, farthest away from the camera or closest to the camera. Thereby the selected references cover the greatest possible region of the rolling mill. In the case of significant deviations from values previously stored in memory, second and/or next to last stands can then be used, and this can then make it possible to recognize, for example, that possibly the gaps of the first or of the last stand, as a function of which stand the deviation was recognized, were subject to a significant deviation, and this is ultimately the reason for the present determination method, namely to recognize such deviations. In particular, this method of procedure makes a rapid intermediate calibration possible, if, for example in the case of minor maintenance work or also during a starting process of a rolling series, undesirable deviations are recognized in the rolling material or at another location, and a rapid check is supposed to be carried out.

It is advantageous if the lens has a fixed focal width, so as to be able to make available a camera having a lens that reaches over all of the roll or guide stands. This makes great stability in the optical arrangement of the camera possible, so that in particular, measurement imprecisions can be reduced to a minimum, in this regard.

It can also be advantageous if different lenses are used for different gap sets, so that when gap sets change between the rolling processes, it is possible to react to the new gap set with a lens that is more advantageous for the new gap set correspondingly quickly. In this regard, the lens of the camera merely has to be replaced, and this allows an adaptation to the new gap set, in a particularly simple manner.

It is advantageous if the different lenses also have different fixed focal widths, because different fixed focal widths could also be necessary for different gap sets, due to changed arrangements and dimensioning, for example because the expansion at a specific fixed focal width is not sufficient to detect the gaps of the first stand in its entirety, and nevertheless be able to detect all the stands and a change in the focal width with sufficient focus, over the rolling mill. Here it can help to arrange the camera farther away, at a reference position, and to select a greater fixed focal width.

In order to make sufficiently accurate pre-positioning of the target along the pass line possible, a target can be arranged on a reference bracket, in a previously defined reference position, before the first step of the corresponding calibration.

It is advantageous if the target, together with the background illumination, is arranged on a reference bracket in a previously defined reference position, so that the background illumination, as well, is pre-positioned with corresponding accuracy, and supplemental construction space must only be provided for this purpose, if at all. Since the target, in an advantageous embodiment, can be arranged directly in front of the background illumination in any case, a joint placement proves to be advantageous.

Preferably, a target or the target is coordinated, in terms of its size, with the reference close to the camera, and the reference away from the camera is coordinated in such a manner that it, together with the references, can be simultaneously detected by the camera. Thus, particularly simple calibration along the pass line can take place, since the target can be oriented simultaneously with the references, along the pass line. For example, the precision with reference to the target suffers when the target is dimensioned to be too small. Overly large dimensioning is also disadvantageous, because then the target might no longer be detected by the camera, to its full extent, through the references.

Because a circular shape, for example, is particularly advantageous for precise detection by the camera, the target can be configured to be circular. Accordingly, the reference close to the camera and the reference away from the camera can be structured in ring shape. In the present case, the positions and, in particular, the center points of the target or of the reference away from the camera and the reference close to the camera can then be determined as precisely as possible, and this then allows the most precise calibration possible. In this regard, it is advantageous if the references are configured in ring shape and the target is configured to be circular, and this improves common orientation or calibration.

Preferably, the rolling or guiding gaps are determined directly after a rolling process. In particular, it is advantageous if the rolling or guiding gaps are determined between individual rolling processes. Thus the rolling process can be monitored better, and a faster reaction is possible, for example if inaccuracies and the like occur, so that defects can be recognized earlier.

In the present connection, a "rolling process" can preferably be understood to mean rolling of a workpiece. An entire rolling series, in which a specific number of workpieces are supposed to be rolled, for example, can be composed of a corresponding number of rolling processes. The determination of the rolling or guiding gaps can thereby also take place after a rolling process, in particular between individual rolling processes, and not just during maintenance work on the rolling mill, because in general, maintenance does not take place after a rolling process or between individual rolling processes, but rather only after an entire rolling series. During determination after a rolling series, this determination would accordingly only take place offline, for example during maintenance. In the present connection, however, the rolling or guiding gaps could also be determined inline or online, after a rolling process or between individual rolling processes, if rolling is not taking place specifically at the determination or during the determination.

Furthermore, the determination of the rolling or guiding gaps between individual rolling processes permits conclusions regarding the rolling process as well as the setting behavior of rolls and stands. Furthermore, wear of the rolls can be determined, and this can lead to a longer useful lifetime of the rolls, and also leads to more precise planning of rolling campaigns. For example, worn rolls can be set more precisely, so that even worn rolls can yield a good rolling quality, in spite of wear. Furthermore, problems of the rolling machine and of the stands can be recognized earlier and can be corrected before serious, expensive damage occurs. In total, maintenance work can be planned better, since it can be better estimated when renewed maintenance work is necessary.

The determination of the rolling or guiding gaps between individual rolling processes, as described above, is specifically possible in that a previously determined pixel factor can be used or merely points already present on the rolling mill are used as references, so that reference sensors do not have to be separately installed between the rolling processes, but rather means that are already present, can be used. It would be possible to install additional reference sensors between rolling processes, but this proves to be extremely complicated and time-consuming. Only a few minutes are available between individual rolling processes, in the best case, for the shortest downtime of the system. On the basis of the implementations explained above, however, it is possible that the rolling or guiding gaps can be determined also during the short time between individual rolling processes.

For timely measurements, it is advantageous if the rolling or guiding gaps are measured in the warm state of the roll stand or of the guide stand. In particular, immediately after a rolling process or between individual rolling processes, high temperatures prevail in the rolling mill, or operating temperatures that are highest immediately after a rolling process and naturally decrease over time, as the result of cooling processes. If measurements are to be taken particularly quickly after a rolling process, the measurement takes place, in particular, in the warm state of the roll stand or of the guide stand.

Preferably, multiple images are produced during measurements in the warm state. These images are then superimposed, wherein visual effects that occur as the result of temperature variations, for example, can be filtered out. In particular, flicker effects can be prevented in this way. It is understood that a correspondingly warm state can occur not just between two rolling processes, but rather, for example, also in the case of interruptions of the rolling process, for example in the case of acute problems.

In particular, the use of a reference position for the camera, the restriction to the determination of the gap shape, as well as the utilization of modules of the roll or guide stands, rolls and/or guides for the calibration allows rapid measurement, so that measurements in as warm a state as possible become possible.

It is advantageous that in the first step, the calibration of the camera and of the information technology device with reference to the rolling mill can take place, without recourse to an orientation of a target arranged on the other one of the input or output sides, in that the orientation takes place by way of utilization of the rolls or guides or other modules of the rolling mill, so as to allow the fastest and easiest possible calibration in the first step, since the orientation relative to a corresponding target, although it yields a significantly more precise calibration, is nevertheless connected with greater effort, in particular an effort in terms of time.

The calibration in the first step, as mentioned above, without recourse to a corresponding target, is particularly advantageous if, in the second step, exclusively the gap shape is determined as a rolling or guiding gap. For the determination of the gap shape, a very precise calibration, making use of a target, is specifically not necessary, so that a rapid but nevertheless sufficiently precise calibration, without recourse to a corresponding target, is sufficient for the determination of the gap shape, and therefore the determination of the gap shape is as effective as possible.

In order to determine rolling or guiding gaps at a predetermined measurement accuracy, with the least possible effort, cumulatively or alternatively, a determination method for determination of the rolling or guiding gaps of the roll stands or guide stands in a multi-stand rolling mill, having a pass line that reaches through the roll stands or guide stands and serves as a reference for a gap offset, wherein first a camera is arranged on one of the input or output sides, and a background illumination is correspondingly arranged on the other of the input or output sides, and subsequently the rolling or guiding gap of the stands is determined, making use of an information technology device, wherein in a first step, the camera and the information technology device are calibrated offline and/or inline with reference to the rolling mill, and wherein in a second step, the camera determines the rolling or guiding gaps inline, making use of the information technology device, can be characterized in that for the calibration in the first step, first a master calibration is carried out, then the camera and the background illumination are removed, and afterward a rolling process is carried out, and that afterward, the camera and the background illumination are arranged on one of the input or output sides again, for an intermediate calibration, and calibrated in the first step, before, in the second step, the camera, making use of the information technology device, determines the rolling or guiding gaps inline once again, wherein for the master calibration, master references are installed on the pass line, and the camera, on the one hand, and the background illumination and a target, on the other hand, are oriented with reference to the pass line defined by the master references, while for the intermediate calibration, no recourse to the use of the master references takes place.

Cumulatively or alternatively, a determination method for determination of the rolling or guiding gaps of the roll stands or guide stands in a multi-stand rolling mill having a pass line that reaches through the roll stands or guide stands and serves as a reference for a gap offset, wherein first a camera is arranged on one of the input or output sides, and a background illumination is correspondingly arranged on the other one of the input or output sides, and subsequently the rolling or guiding gaps of the stands are determined, making use of an information technology device, wherein in a first step, the camera and the information technology device are calibrated offline and/or inline, with reference to the rolling mill, and wherein in a second step, the camera determines the rolling or guiding gaps inline, making use of the information technology device, can be characterized in that for the calibration, in the first step, first a master calibration is carried out, then the camera and the background illumination are removed, and afterward a rolling process is carried out, and afterward, the camera and the background illumination are arranged on one of the input or output sides again, for an intermediate calibration, and are calibrated in the first step, before, in the second step, the camera, making use of the information technology device, determines the rolling or guiding gaps inline once again, wherein for the master calibration master, references are installed on the pass line, and the camera, on the one hand, as well as the background illumination and a target, on the other hand, are correspondingly measured with reference to the position of the pass line with reference to the camera, and stored in memory in the information technology device, while for the intermediate calibration, there is no recourse to the use of the master references, so as to determine rolling or guiding gaps, at a predetermined measurement accuracy, with the least possible effort.

The term "master calibration" refers, in the present case, in particular, to a calibration in which a camera and an information technology device are fundamentally calibrated with reference to a rolling mill, with the greatest possible precision. The master calibration preferably takes place offline or also inline. In this regard, separate master references are installed in the rolling mill, in a fixed location. Proceeding from these fixedly installed master references, the most precise possible calibration of the camera and the information technology device can take place. This process is comparatively complicated, due to the installation of the master references, because they must be mounted on the corresponding roll stand itself, and therefore the work must be performed in a region of the rolling mill that is difficult to access and very dirty. Increased effort must also be expected in the case of the use of one or more calibration stands, as stands, which are specifically set up and suitable for a calibration process, and are essentially used only for calibration purposes, because they are introduced into the rolling machine with the acceptance of corresponding setup times, accordingly, and must be removed from it again, wherein, depending on the concrete situation, roll or guide stands also have to be removed first and afterward put in place again. However, a master calibration is advantageous, in particular, in offline phases of the rolling mill, because one can achieve the best possible calibration.

In the present connection, an "intermediate calibration" can preferably be understood to mean a calibration that, in contrast to the master calibration, can make do without master references, wherein instead, for calibration of a camera and an information technology device with reference to a rolling mill, all the other components of a rolling mill can be used as references, such as, for example, rolls, guides, stands, etc. For this reason, an intermediate calibration can also take place relatively quickly between individual rolling processes, without additionally fixedly installed references having to be brought into the rolling mill. As compared with a master calibration, it is true that the intermediate calibration is less precise, overall, but it is clearly simpler and faster, or could be implemented between individual rolling processes. The intermediate calibration can preferably be used, particularly well, for recalibration, because elements of a rolling mill also partially shift, move, expand, loosen or can change in some other way, with the number of rolling processes, due to the stresses, in such a manner that the gaps are no longer present, over the course of time, in precisely the same way as they were present at the time of the master calibration. In these cases, recalibration or the intermediate calibration can counteract this, so that possible defects can be recognized early, corrected or prevented.

In the present connection, "master reference" can be understood to mean a reference that is used for the master calibration. This is preferably introduced or installed into the rolling mill separately. For example, the master references can be configured as cruciform reference sensors, the cross of which can be oriented on the pass line in a particularly simple manner, for rapid pre-positioning of the camera. In particular, the master references can, if applicable, also be used as references close to the camera and away from the camera, for the intermediate calibrations. Furthermore, it is advantageous if one of the master references is arranged close to the camera, and the other one is arranged away from the camera, so as to allow the most precise calibration possible, in particular a master calibration, of the entire region of the rolling mill. Furthermore, the master references can be calibration rings.

If the method is managed appropriately, the calibration can happen more quickly, in particular if there is no recourse to the use of master references for the intermediate calibration.

The fact that for the calibration, in the first step, first a master calibration is carried out, then the camera and the background illumination are removed, and afterward a rolling process is carried out, and afterward, the camera and the background illumination are arranged on one of the input or output sides again, for an intermediate calibration, and are calibrated in the first step, before, in the second step, the camera, making use of the information technology device, determines the rolling or guiding gaps inline once again, can advantageously be used accordingly, even independent of the determination method explained directly above, for the other determination methods explained here.

In particular, by means of not having recourse to master references in the intermediate calibration, the calibration process can be accelerated, in deviation from the known calibration processes, for example according to WO 2013/037350 A2 or JP 2002-035834 A.

Preferably, the master calibration is accordingly carried out offline or also inline, for example during maintenance, because this is connected with relatively significant expenditure in terms of time and construction. However, in this way a fundamental first very precise calibration of the system is achieved. In particular, pixel factors, for example, and the like can be stored in memory in the information technology system, and these can then be available for the intermediate calibrations. Subsequently, merely intermediate calibrations are sufficient for a further precise calibration of the entire system, and these can furthermore take place significantly faster or with significantly less effort than a master calibration. Furthermore, the intermediate calibration can take place inline, without additional master references having to be mounted in the rolling mill. At the appropriate time, a master calibration can be carried out once again, for example if the rolling mill must be shut down for an extended period of time, due to maintenance work or due to replacement of a gap set.

In order to determine rolling or guiding gaps, at a predetermined measurement accuracy, with the least possible effort, cumulatively or alternatively, a determination method for determination of the rolling or guiding gaps of the roll or guide stands in a multi-stand rolling mill, having a pass line that reaches through the roll stands or guide stands and serves as a reference for a gap offset, wherein first, a camera is arranged on one of the input or output sides, and a background illumination is accordingly arranged on the other of the input or output sides, and subsequently the rolling or guiding gap of the stands is determined, making use of an information technology device, wherein in a first step, the camera and the information technology device are calibrated offline and/or inline with reference to the rolling mill, and wherein in a second step, the camera, making use of the information technology device, determines the rolling or guiding gaps inline, can be characterized in that for the calibration, in the first step, first a master calibration is carried out, then the camera and the background illumination are removed, and afterward a rolling process is carried out, and afterward, the camera and background illumination are arranged on one of the input or output sides once again, for an intermediate calibration, and calibrated in the first step, before, in the second step, the camera, making use of the information technology device, determines the rolling or guiding gaps inline once again, wherein for the master calibration, at least three reference scales are recorded, offline at reference heights previously defined with reference to the pass line, in each instance, or inline in the case of at least one stand removed from the rolling mill, and a pixel factor determined from the reference scales is stored in memory in information technology devices.

In the present connection, a "reference height" can preferably be understood to mean the position along the pass line, so that ultimately, the position of a corresponding stand along the pass line, in particular for reference purposes, can be defined by the reference height.

By means of these steps, in deviation from or supplemental to known calibration processes, such as, for example, according to WO 2013/037350 A3 or JP 2002-035834 A, and within the scope of the master calibration, a very precise calibration can take place by way of three reference scales, in each instance, and for this reason, it is advantageous if this is particularly recorded offline or inline, in the case of at least one stand removed from the rolling mill. Therefore, before the actual rolling process, the reference scales can be recorded within the scope of the master calibration, and then a pixel factor determined from the reference scales can be stored in memory. The stored pixel factor can then be called up again or processed again by the information technology device, so that recording of the reference scales only needs to take place once, before the rolling process, within the scope of the master calibration, and at a later point in time, the stored data can be called up again in the form of a pixel factor. Therefore the reference scales do not have to be newly recorded again, for example in the case of intermediate calibrations, which would be connected with additional effort. Furthermore, the possibility exists that if the reference scales are recorded later, for example during an intermediate calibration, all the elements in the rolling mill that are required for the reference scales might no longer be visible to the camera, for example because rolls or guides or roll stands or guide stands are arranged in the viewing field of the camera. In the case of a master calibration, which takes place offline, for example, corresponding recording of the reference scales can take place in as collision-free a manner as possible. Thereby, if the process is managed appropriately, rapid calibrations can take place by way of the pixel factor values stored in memory.

A determination method for determination of the rolling or guiding gaps of the roll stands or guide stands in a multi-stand rolling mill, having a pass line that reaches through the roll stands or guide stands and serves as a reference for a gap offset, wherein first a camera is arranged on one of the input or output sides, and a background illumination is correspondingly arranged on the other one of the input or output sides, and subsequently the rolling or guiding gap of the stands is determined, making use of an information technology device, wherein in a first step, the camera and the information technology device are calibrated offline and/or inline with reference to the rolling mill, and wherein in a second step, the camera determines the rolling or guiding gaps inline, making use of the information technology device, can also be characterized, cumulatively or alternatively, in that for the calibration in the first step, first a master calibration is carried out, then the camera and the background illumination are removed, and afterward a rolling process is carried out, and afterward the camera and the background illumination are arranged on one of the input or output sides again, for an intermediate calibration, and calibrated in the first step, before, in the second step, the camera determines the rolling or guiding gaps inline once again, making use of the information technology device, wherein for the master calibration, reference positions for the camera and a target are established with reference to the pass line, the position of the pass line with reference to the camera and the target is stored in memory in the information technology device, and at least one reference scale, in each instance, of two references to be used for intermediate calibrations, is measured, and a pixel factor determined from the reference scales is stored in memory in the information technology device, so as to determine rolling or guiding gaps at a predetermined measurement accuracy, with the least possible effort.

It is conceivable that two reference scales are also measured, in particular these lie orthogonally on one another, so as to be able to make corresponding reference scales available in the perpendicular direction, as well.

The references to be used for the intermediate calibration can preferably be the reference close to the camera and the reference away from the camera, as already explained above. These can also be calibration rings, for example.

If the process is managed appropriately, in this way, in deviation from known determination methods, as they are disclosed in WO 2013/037350 A2 or JP 2002-035834 A, for example, rapid calibrations can take place by way of the values stored in memory, since these are recorded one, during the master calibration, and the values stored in memory or the pixel factor can be used for the intermediate calibrations.

Preferably, the intermediate calibration can also be used as a calibration in the first step of the determination method explained initially, because while it is true that the master reference can ensure, in general, the most precise determination of the pass line or the more precise calibration, the intermediate calibration, specifically, can be sufficient for faster measurements. Therefore the master references and thus also the master calibration can serve for all the determination methods, for an overall calibration.

Preferably, for the master calibrations, reference positions are established for the camera and the target together with the background illumination, with reference to the pass line, the position of the pass line, with reference to the camera and the target together with the background illumination, is stored in memory in the information technology device, and, at least one reference scale, in each instance, of two references to be used for the intermediate calibrations is measured, and a pixel factor determined from the reference scales is stored in memory in the information technology device. In this way, essential data relevant for the master calibration, as well as data relevant for the intermediate calibration can be stored in memory in the information technology device and called up from there again at a later point in time. The data stored in memory therefore only have to be determined once, and can be called up again easily and quickly, as a pixel factor, and used so as to then be included in a particularly simple determination of the rolling or guiding gaps. Because the processes described are time-consuming, in particular, in this way a significant savings of time can be achieved. Furthermore, the master calibration and the measuring of the reference scale might not be so easy to carry out, for example between two rolling processes, since additional references would have to be introduced into the rolling mill again or not all the necessary regions of the rolling mill could be viewed any longer. However, a pixel factor determined from the reference scales is stored in memory, so that these scales can be called up between rolling processes, so as to then undertake intermediate calibrations, for example.

In order to not have to arrange any mechanical reference scales in the rolling mill at every point in time, or not to have to arrange them to be visible for the camera, or not to have to additionally install further reference scales, it is advantageous if, to measure the reference scales, a ruler, in each instance, is set at a reference height previously defined with reference to the pass line, and measured by the camera, making use of an information technology device, wherein the measurement result can be stored in memory in the information technology device, as a pixel factor. This factor can then be called up again at a later point in time, for example for an intermediate calibration, and used for the determination of a rolling or guiding gap. Therefore measuring of the reference scales only has to take place once or only in the case of a master calibration.

It is advantageous if only two references are used for the intermediate calibration, since these can be sufficient for a sufficiently precise calibration, and thereby the intermediate calibration can take place with the least possible effort, in particular with the least possible effort in terms of time. In particular, here the reference sensor close to the camera and the reference sensor away from the camera can be used, as has already been explained above, wherein, depending on the desired effort, it might be possible to do without reference sensors that are set in place separately, if the measurement is supposed to take place quickly.

Preferably, for the master calibration, for recording at least one of the three reference scales, more than two stands are removed. In this way, the most precise calibration possible can take place, since sufficient access possibilities can be created, as well as the most collision-free calibration possible, since the stands are not arranged in the viewing field between the camera and the reference scale. For this reason, a master calibration in the offline state of the rolling mill also proves to be particularly advantageous.

In order to achieve the same advantages, it can be advantageous if, for the master calibration, all of the stands are removed for recording at least one of the three reference scales.

Preferably, to establish the reference position of the camera and of the target with reference to the pass line, master references are installed at related reference positions, for example on the first and the last roll or guide stand, which references can be detected by the camera and the information technology device. In this manner, a very precise master calibration or a very precise overall calibration of the camera or of the information technology device can take place by way of the master references.

It is advantageous if, for establishing the reference positions of the camera and of the target with reference to the pass line, the position of the camera is varied. For the most precise calibration possible, it can be helpful to change the position of the camera and to adapt it to the reference position. In order to achieve the same advantages, it is advantageous if, to establish the reference position of the camera and of the target with reference to the pass line, the position of the target is varied.

For example, the camera can be repositioned until the crosses of the two cruciform reference sensors agree precisely or the target be shifted until the crosses are concentrated relative to the target. In this manner, the camera or the target are then positioned accordingly with reference to the pass line, so that this arrangement is then also calibrated accordingly.

On the other hand, the detected position of the master references can be stored in memory in the information technology device, as the position of the pass line, so as to be able to call this position up again for a subsequent orientation close to the reference positions, so that the position of the master references only has to be detected once, and this can be used as the basic position for establishing the reference positions.

It is advantageous if, during the master calibration, at least one reference offset of a reference to be used for intermediate calibrations is measured and stored in memory in the information technology device, in order to thereby be able to store a reference offset in memory directly, in connection with the master calibration, which offset can then be used in a next step, for example for the intermediate calibrations, so that this offset then does not have to be measured in addition. It is conceivable that the reference offset can be a distance between rolls, if rolls or guides are used as a reference.

It is advantageous if, during the master calibration, at least two linearly independently oriented reference scales for a reference to be used for intermediate calibrations are measured, and a pixel factor determined from the reference scales is stored in memory in the information technology device, in order to then call this factor up for intermediate calibrations, in the simplest possible manner, and to be able to use it for the rapid determination of the rolling or guiding gaps.

Here, two reference scales oriented orthogonally relative to one another prove to be particularly advantageous, because in this way, the essential directions of the reference scales can also be detected. Also, such an arrangement allows a simple optical comparison, which is the same in all directions, for example if orientation of the camera is supposed to take place.

In order to achieve the same advantages, it is particularly advantageous if, for all the references to be used for intermediate calibrations, the reference scales are measured accordingly, and a pixel factor determined from the reference scales is stored in memory in the information technology device, because then the most possible effort can be reduced.

It is advantageous, for the entire informational value regarding the quality, as well as the accuracy of the measurement, if the camera records multiple images during the measurement and compares them with one another. Thus, possible deviations and errors can be recognized or reduced. Such errors can occur, for example, due to flickering, caused by heat, dust, vapor or water, or also due to building fluctuations that cause fluctuations of the camera, as well as similar problems. In particular, a mathematical error analysis can also take place, for example, so that a statement regarding the quality of the measurement can be made.

Furthermore, filters used for the camera can be changed during the measurement. Different images during a measurement also result from the use of different filters during the measurement. In this regard, each filter can yield a unique quality of the images, and thereby the quality of the measurement is also changed with the use of different filters.

A greater number of images having a different quality or resulting from different filters can therefore yield even better conclusions regarding the quality of the measurement as a whole. Taking into consideration possible inaccuracies or other errors during the measurement, a better statement regarding the quality of the measurement can be made for purely statistical reasons, with a greater number of images, in particular with different filters, and thereby the quality of the measurement can also be increased as a whole. With this basis, an image with the least possible deviation from reality can then be determined, in other words also the quality of the measurement and, in particular, a uniform quality of the measurement can be assured. The use of different filters during the measurement proves to be practical, preferably in the case of automatic measurements, because in the case of automation, it is possible to use the different filters as easily and quickly as possible, and to produce corresponding images.

In the present connection, the term "quality" can preferably be understood to mean the dimensional accuracy of the measurement. Depending on the filters used, however, other qualitative statements can also be made, such as, for example, the precision of thermal measurements when corresponding filters are used.

It is understood that the characteristics of the solutions described above and in the claims can also be combined, if applicable, so as to be able to implement the advantages cumulatively, accordingly.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
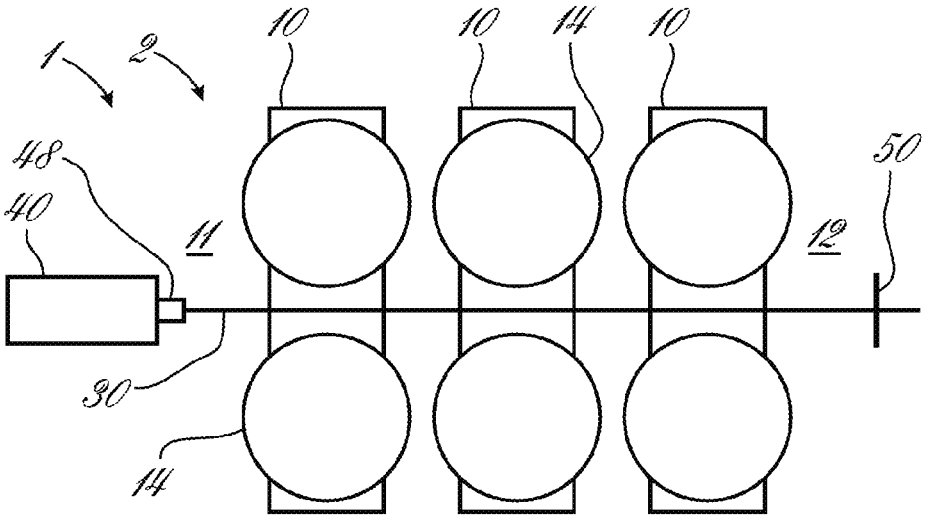
FIG. 1 shows a first rolling mill in a schematic view.

In a first exemplary embodiment according to FIG. 1, a rolling mill 1 comprises a rolling machine 2 having three roll stands 10, which are arranged between an input side 11 and an output side 12 of the rolling mill 1 or of the rolling machine 2 and each carry rolls 14. Furthermore, the rolling mill 1 comprises a pass line 30, which ultimately corresponds to the intended pass-through center workpiece to be rolled, such as, for example, a pipe, a billet or a rod.

For measurement of the rolling or guiding gap, a camera 40, comprising a lens 48 having its optical axis or also defined otherwise, alternatively, is placed approximately on the pass line 30.

Furthermore, in the case of the present exemplary embodiment, a background illumination 50 is provided on the output side, in other words on the side that lies opposite to the camera 40, which illumination emits a sufficiently uniform light to the camera 40, so that the contours of the rolls 14 to be measured, in each instance, are clearly distinguished against the background illumination 50.

In a concrete application, background illumination 50 that can be used is, for example, a light plate, preferably with filter films or with LEDs, if necessary collimated LEDs, which reduce the exit angle from the light plate, so as to minimize scattered light.

Figure 2:
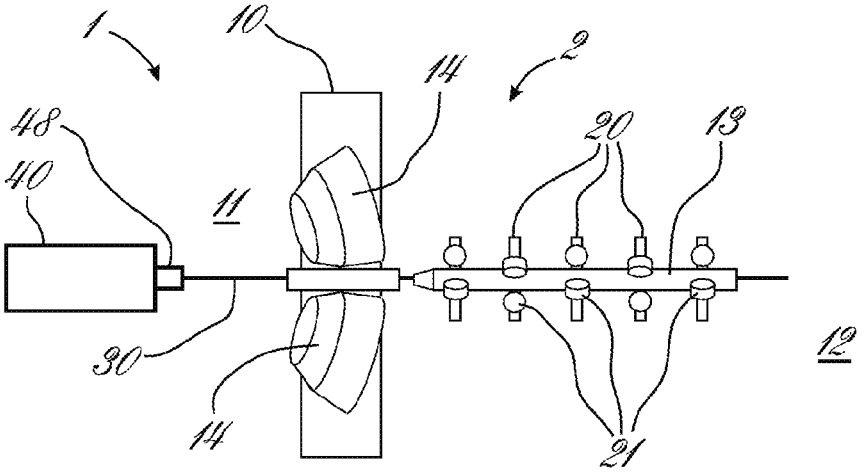
FIG. 2 shows a second rolling mill in a schematic view.

In a further exemplary embodiment according to FIG. 2, the rolling mill 1 shown there, in deviation from the rolling mill 1 of the first exemplary embodiment according to FIG. 1, which comprises multiple such roll stands 10, comprises a rolling machine 2 having only one roll stand 10, as well as two conical rolls 14, set at a slant, which are arranged on the roll stand 10, wherein in the case of this rolling mill 1, furthermore a plurality of guides 21 is provided, which are arranged, in each instance, on guide stands 20, and guide a mandrel bar 13. The guides 21 are opened radially, successively, with regard to each guide stand 20, when a workpiece, driven by way of the mandrel bar 13, reaches the corresponding guide stand 20. The guides 21 are configured as circular disks in the case of this exemplary embodiment, wherein it is not compulsory but practical, if applicable, if they can also roll, as rolls. In the case of such an arrangement, as well, a determination of the gaps, in other words, in particular of the rolling gap and of the guide gap, appears to be advantageous, accordingly.

It is understood that in the present exemplary embodiment, as well, a background illumination 50 can be arranged on the output side, similar to the first exemplary embodiment, but this is not shown in the present representation in FIG. 2.

The embodiments explained above, according to FIGS. 1 and 2, show arrangement of a rolling mill known from the state of the art, so as to measure rolling or guiding gaps by means of a camera 40.

In a further exemplary embodiment according to FIGS. 3 to 6, the individual steps of a determination method for determination of a rolling or guiding gap are shown.

Figure 3:
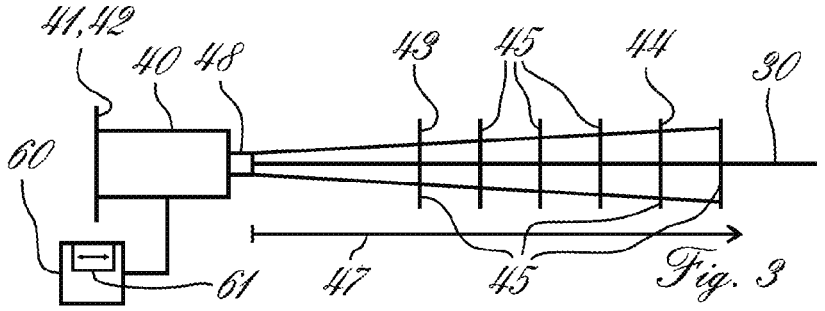
FIG. 3 shows the calibration with reference positions without roll stands, in a schematic view.

In a first step, which is shown in FIG. 3, a camera 40 having a lens 48 is arranged along a pass line 30, wherein the camera 40 is arranged at a reference position 41 by way of a reference bracket 42. Parallel to the pass line 30, a reference height 47 is defined, by way of which the reference position 41 of the camera 40 along the pass line 30 is defined. The reference height 47 thereby describes the position of the reference position 41 with reference to the pass line 30.

In the viewing field of the camera 40, multiple reference positions 45 are arranged at different reference heights 47. At a first reference position 45, furthermore, a reference sensor 43 close to the camera is arranged, while at a second reference position 45, a reference sensor 44 away from the camera is arranged, wherein the reference sensor 43 close to the camera is situated closer to the camera 40 than the reference sensor 44 away from the camera.

In this step, the camera 40 and an information technology device 60 connected with the camera 40 are calibrated offline, with reference to the rolling mill 1, by means of the reference sensor 43 close to the camera and the reference sensor 44 away from the camera, which sensors are arranged, in each instance, not between rolls 14 or guides 21 of a first stand 10, 20 and rolls 14 or guides 21 of a last stand 10, 20. In the viewing field of the camera 40, the reference sensor 43, 44 as well as, if applicable, reference scales 46 arranged at the corresponding reference positions 45 (not shown separately in FIG. 1) form objects, in each instance, that can be measured and recognized by the camera 40.

In this regard, before this calibration, first the camera 40 is positioned on the reference bracket 42, in a previously defined reference position 41, and the reference sensor 43 close to the camera and the reference sensor 44 away from the camera are arranged in previously defined reference positions 45. Then, for the calibration corresponding to the first step, the reference close to the camera and the reference away from the camera, 43, 44 are measured by means of the camera 40 and the information technology device 60, and subsequently the pass line 30 is determined from the measurement result.

At the same time, a pixel factor is determined from the measurement result.

Figure 4:
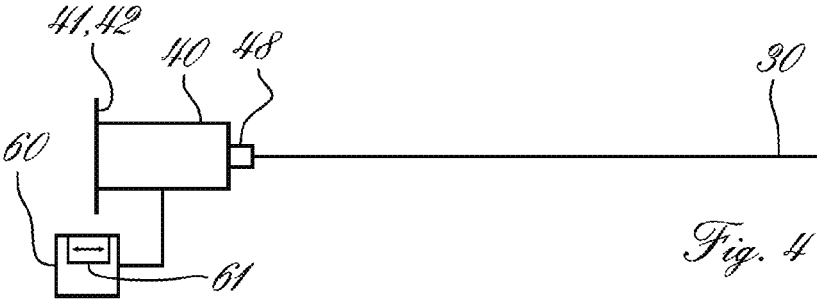
FIG. 4 shows storing of the reference positions in an information technology device, in a schematic view.

In a next step, as it is shown in FIG. 4, the reference positions 45, in particular the reference positions 45 of the reference sensors 43 and 44, as well as also the related pixel factors, are stored in memory in the information technology device 60 that is connected with the camera 40. In this regard, depending on the concrete requirements, if applicable the pixel factors for reference positions 45 between the reference sensors 43, 44 close to the camera and away from the camera, if applicable, can also be extrapolated by way of beam sets, so that if applicable, storing in memory and measuring is not necessary at these reference positions 45.

The actual reference sensors 43 and 44 are no longer arranged in the viewing field of the camera 40 in this step, in the case of this exemplary embodiment, because their reference positions 45 are stored in memory in the information technology device 60 in the present step, and therefore their placement is no longer necessary. However, storing in memory can also take place if these are not yet in position there.

In the first steps according to FIGS. 3 and 4, a calibration of the camera 40 and of the information technology device 60 therefore takes place offline, with reference to a rolling mill 1 having a rolling machine 2. This can also take place at a completely different location, if necessary, for example, in a separate equipment hall. In particular, the measurement can take place offline, directly at the rolling mill, for the measurements between the reference sensors 43, 44 close to the camera and away from the camera, by means of taking away the stands 10, 20. It is understood that a corresponding calibration of the camera 40 and the information technology device 60 can also take place inline, in particular if it is possible to do without the determination of the pixel factor at reference positions 45 between the reference sensors 43, 44 close to the camera and away from the camera.

Figure 5:
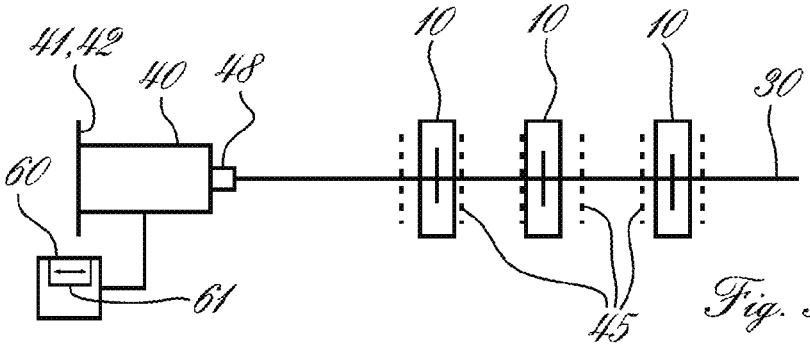
FIG. 5 shows application of the stored reference positions to a first roll stand arrangement, in a schematic view.

In a next step, as it is shown in FIG. 5, roll stands 10 are also arranged in addition to the arrangement from the previous steps in the pass line 30. Thus this step is also preferably carried out inline, accordingly. If applicable, if the camera 40 or the background illumination 30 and, if applicable, a target 53 were moved, a new calibration of these modules with reference to the pass line 30 and with reference to a current pixel offset is carried out, at least at the reference positions of the reference sensors 43, 44 close to the camera and away from the camera.

The camera 40 then calls up the reference positions 45 stored in the memory of the information technology device 60, by way of this device 60, as well as the related data, such as a pixel factor and, if applicable, an offset, which were previously measured and stored in memory offline in the prior step. As virtual references, these reference positions 45 can now be called up again, and by way of triangulation, a conversion to the actual positions of the roll stands 10 or also any possible guide stands can be carried out. From this, the rolling or guiding gaps can then be determined.

Figure 6:
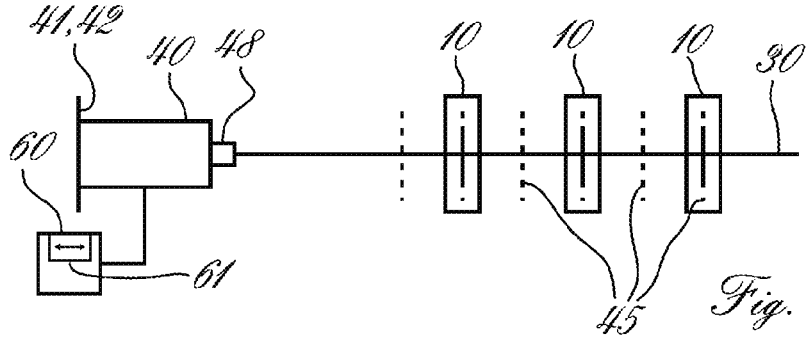
FIG. 6 shows application of the stored reference positions to a second roll stand arrangement, in a schematic view.

A further exemplary embodiment according to FIG. 6 differs from the exemplary embodiment of FIG. 5 in that the previously measured and then called up reference positions 45 stored in memory lie precisely at the position of the roll stands 10 or of guide stands, so that the values can be taken over directly. If applicable, here too a calibration is first carried out, if the camera 40 or the background illumination 50 and, if applicable, a target 53 were moved.

Figure 7:
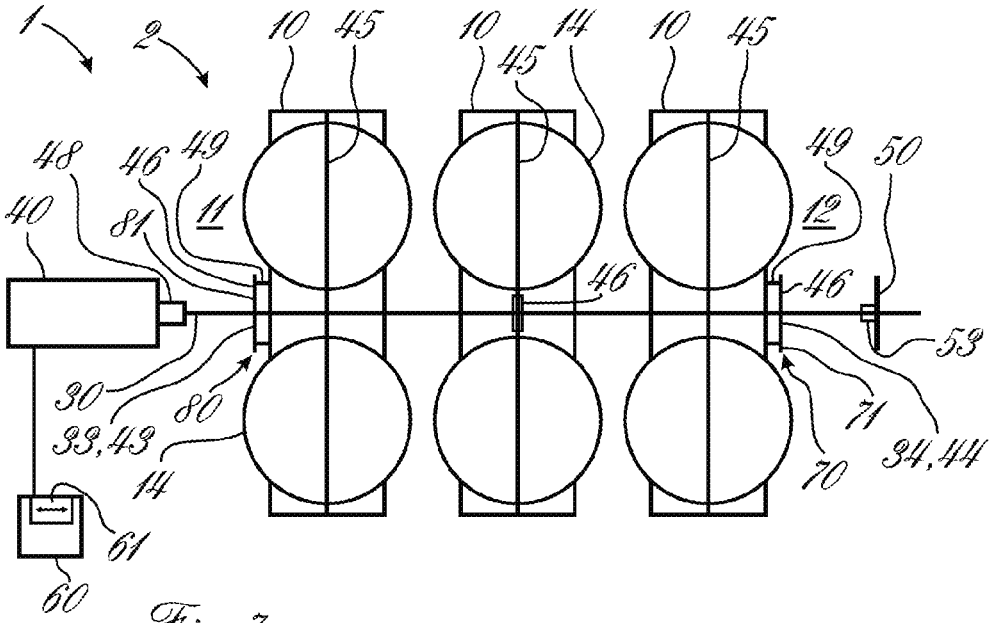
FIG. 7 shows a third rolling mill, in a schematic view.

In a further exemplary embodiment according to FIG. 7, which has the fundamental arrangement of the first exemplary embodiment according to FIG. 1, a first reference sensor 81, which is also used as a master reference 80, is additionally provided on the first roll stand 10, from the point of view of the camera 40, and a second reference sensor 71, which is also used as a master reference 70, is arranged on the corresponding last roll stand 10.

Furthermore, the reference sensors 71, 81 are configured as calibration rings 33, 34, wherein the calibration ring 33 can represent a reference sensor 43 close to the camera, and the calibration ring 34 can then represent a reference sensor 44 away from the camera, which can also be used, if applicable, for intermediate calibrations and, as already above, for master calibrations. In this regard, the master references 70, 80 are arranged, in each instance, on a reference stand 49, which is in the case of this exemplary embodiment, for its part, on the first or last roll stand 10, so that the master references 70, 80 can be installed at a specific position, in operationally reliable manner, in the simplest possible manner. In alternative embodiments, here an independent reference stand 49 can be provided, replacing the corresponding roll stand 10, but ultimately this only appears to be efficient for master calibrations, due to the effort and expense.

The camera 40 comprises a lens 48 and is furthermore connected with an information technology device 60, which comprises a measurement direction input possibility 61. The lens has a fixed focal length. Furthermore, it is conceivable that different lenses 48 are used for different gap sets, in particular having different fixed focal lengths, so that these can be adapted to the corresponding gap set.

Furthermore, a circular target 53 is arranged on a background illumination 50, which target lies in the viewing field of the camera 40 and can be displaced perpendicular to the pass line 30.

In addition, reference scales 46 can be arranged on the individual roll stands 10, at the corresponding reference positions 45 of the roll stands 10, in each instance. This is a separate reference scale 46 for the central roll stand 10, for example in the form of a ruler that is brought to the corresponding reference position 45 when the roll stand is removed. If applicable, a separate reference stand 49 can also be used for this purpose. For the remainder, the master references 70, 80 or the reference sensors 43, 44 or 71, 81, which are provided in any case, are used as reference scales 46, wherein it is assumed that the deviations along the pass line 30, between the position of the master references 70, 80 or the reference sensor 43, 44 or 71, 81, relative to the related reference positions 45 are insignificant, in light of the very great distance between camera 40 and rolling machine 2, within the scope of the desired measurement accuracy. Otherwise, if applicable, the master references 70, 80 or the reference sensor 43, 44 or 71, 81 can be arranged differently, or supplemental reference scales 46 can be provided at the desired positions.

Using the arrangement of the present exemplary embodiment according to FIG. 7, rolling or guiding gaps of the roll stands are determined in a master calibration. In this regard, the target 53 can ensure that possible fluctuations of the camera 40 in the images taken, in each instance, can be recognized and calculated back.

Furthermore, it is understood that using the method described here, in all steps, guide gaps of guide stands 20 can also be determined, as long as guide stands 20 are used in the rolling mill 1.

The camera 40 is first arranged on the input side 11, and the background illumination 50 is arranged on the output side 12, accordingly. Then the correspondingly selected calibration takes place. Subsequently, the rolling gap of the roll stands 10 is determined, making use of the information technology device 60. It is conceivable that in an alternative embodiment, the camera 40 is also first arranged on the output side 12, and the background illumination 50 is arranged on the input side 11, accordingly.

In a first step, the camera 40 and the information technology device 60 are calibrated with reference to the rolling mill 1, for example offline. However, it is also conceivable that the corresponding calibration can take place inline. In this regard, the first calibration ring 33 and the second calibration ring 34 are arranged in the pass line 30 as master references 70, 80. Subsequently, the position of the camera 40 and the position of the target 53 are changed in such a manner that the two calibration rings 33, 34, surrounding the target 53, can be detected separately by the camera 40.

For the calibration in the first step of the present exemplary embodiment, first a master calibration is carried out, then the camera 40 and the background illumination 50 are removed, so that subsequently, a rolling process is carried out or the roll stands 10 and, if applicable, also guide stands 20 are inserted into the actual rolling machine 2, when the master calibration takes place in an equipment hall or at another position. Afterward, the camera 40 and the background illumination 50 are arranged at one of the input 11 or output sides 12 again, for an intermediate calibration, and calibrated in this first step, before, in the second step, the camera 40, making use of the information technology device 60, determines the rolling gaps or, if applicable, also the guiding gaps are determined inline.

For the master calibration, the master references 70, 80 are installed on the pass line 30. The camera 40, on the one hand, as well as the background illumination 50 and the target 53, on the other hand, are oriented with reference to the pass line that is defined by the master references 70, 80. At the same time, the position of the pass line 30 is measured with reference to the camera 40 and to the target 53, and stored in memory in the information technology device 60. For the intermediate calibration, it is possible to do without the use of the master references 70, 80, if applicable.

For the master calibration, the three reference scales 46 are recorded offline, in each instance, at reference heights previously defined with reference to the pass line 30, wherein it is also conceivable that these can be recorded inline on at least one stand 10 away from the rolling mill 1. From the reference scales, a pixel factor is then determined and stored in memory in the information technology device. For intermediate calibrations, it can also be possible to use the reference sensors 43, 44 used as the master references 70, 80. If applicable, the rolls 14 or guides 21 or other modules, in particular of the first or last roll or guide stands 10, 20, can also be used for this purpose, because then it is possible to do without the installation and removal of separate reference sensors.

In addition, in the case of this exemplary embodiment, reference positions for the camera 40 and the target 53 with reference to the pass line 30 are established by means of the master calibration, and then the position of the pass line 30 with reference to the camera 40 and the target are stored in memory in the information technology device. At least one reference scale 46, in each instance, of two references 43, 44 to be used for intermediate calibrations is measured, and a pixel factor determined from the reference scales 46 is then stored in memory in the information technology device.

Before the calibration of the present exemplary embodiment that corresponds to the first step, the target 53, together with the background illumination, is positioned on the reference bracket 42 in a previously defined reference position. The target 53 is coordinated, in terms of its size, with the reference 43 close to the camera and the reference 44 away from the camera, in such a manner that it can be detected by the camera 40 at the same time together with the references 43, 44. The target 53, the reference 43 close to the camera and the reference 44 away from the camera are configured to be circular, in this regard.

If the diameter of the calibration rings 33, 34 is known, these can be used as a reference scale 46.

It is possible that the rolling or guiding gaps are determined directly after a rolling process, in particular between individual rolling processes.

Likewise, it is conceivable that the rolling or guiding gaps are measured in the warm state of the roll stand 10 or of the guide stand 20.

In a second step, the camera 40 determines the rolling gap inline, making use of the information technology device 60. In this step, it is conceivable that exclusively the gap shape is determined as the rolling gaps.

Figure 16:
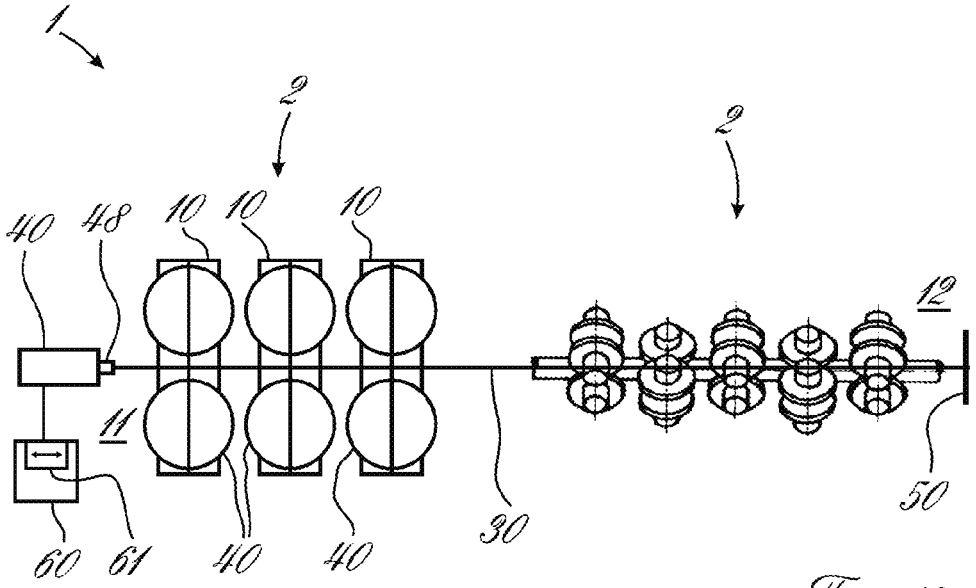
FIG. 16 shows a fourth rolling mill having two rolling machines, in a schematic view.

Furthermore, in an alternative embodiment, it is possible that in this second step, exclusively the gap offset from a pass line 30 reaching through at least two rolling machines 2 of a rolling mill 1 comprising at least two rolling machines 2, as it is shown in FIG. 16, is determined as a rolling or guiding gap. Here, it may be true that for a sufficient determination of the actual rolling gap, the depth of focus through such a long rolling mill 1 is not sufficient, but the relative position of the individual rolling gaps can still be determined with sufficient precision. In particular, in such cases the use of a target 53 appears to be indispensable.

In the present exemplary embodiment according to FIG. 7, furthermore the roll stands 10 are referred to successively as a function along the pass line 30 in the information technology device 60. By way of a measurement direction input possibility 61 of the information technology device 60, placement of the camera 40 on the input side 11 and of the background illumination 50 on the output side 12 or vice versa, and thereby the measurement direction can be entered. Thus, possible measurement results can be assigned to each of the stands 10, 20, independent of the measurement direction, by the information technology device 60, to the corresponding stands 10, 20, wherein in a preferred implementation, the recorded images are also mirrored in the case of a reversal of the measurement direction.

It is conceivable that the reference sensor 43 close to the camera or the reference sensor 44 away from the camera can be one of the rolls 14, one of the guides 21, one of the rolling 10 or guide stands 20, a reference stand 49 or a reference sensor 71, 81. This holds true, in particular, for intermediate calibrations.

As master references 70, 80, references such as those shown in FIGS. 8 to 11, for example, can be used. It is understood that the master references shown here can, however, also be used as other references, and cannot be used exclusively as master references 70, 80.

Figure 8:
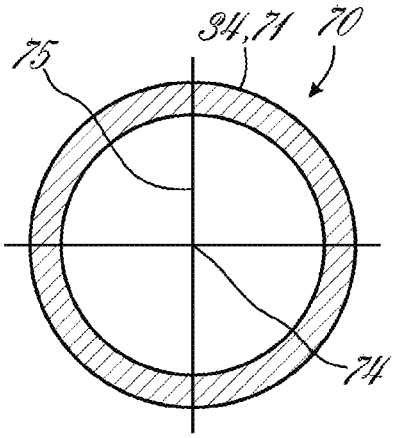
FIG. 8 shows a first master reference, in a schematic view.

In the exemplary embodiment according to FIG. 8, a reference sensor 71 is configured as a calibration ring 34 that comprises two reference arms 75. The reference arms 75 are attached, in each instance, at two locations on the reference sensor 71, wherein the two reference arms 75 meet at a central reference point 74. Furthermore, the two reference arms 75 are arranged horizontally and vertically as well as at a right angle to one another. The reference arms 74 serve for being able to adjust the camera 40 for a first orientation quickly, but with sufficient precision.

Figure 9:
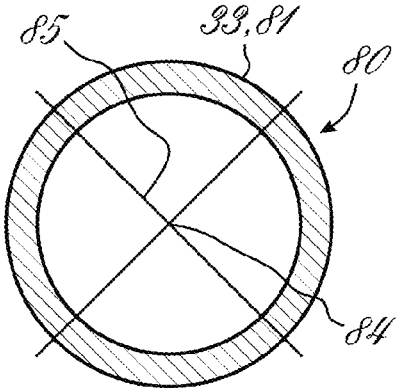
FIG. 9 shows a second master reference, in a schematic view.

A further reference sensor 81 configured as a master reference 80 can comprise, as shown in FIG. 9, a fundamental arrangement of the reference sensor 81 or calibration ring 33 and of the reference arms 85 according to FIG. 8, wherein, however, the reference sensor 81 of the present exemplary embodiment is arranged offset by an angle of 45°, so that the two cruciform reference sensors 71, 81 are oriented differently.

Figure 10:
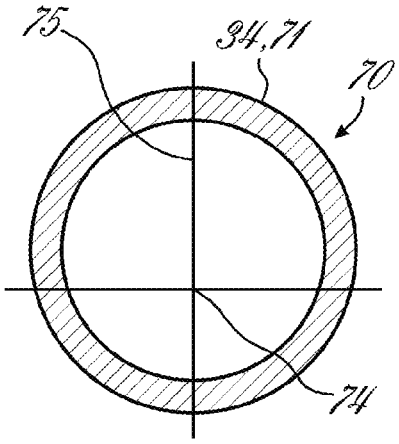
FIG. 10 shows a third master reference, in a schematic view.

In a further exemplary embodiment of a master reference 70 according to FIG. 10, the master reference 70 is once again configured as a circular calibration ring 34. However, the cruciform reference sensors 71 are arranged in such a manner that the central reference point 74 is not arranged centrally in the center point of the reference sensor 71, as was the case in the previous exemplary embodiments according to FIGS. 8 and 9.

Figure 11:
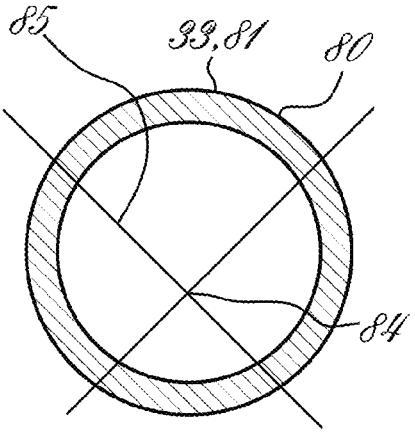
FIG. 11 shows a fourth master reference, in a schematic view.
Figure 12:
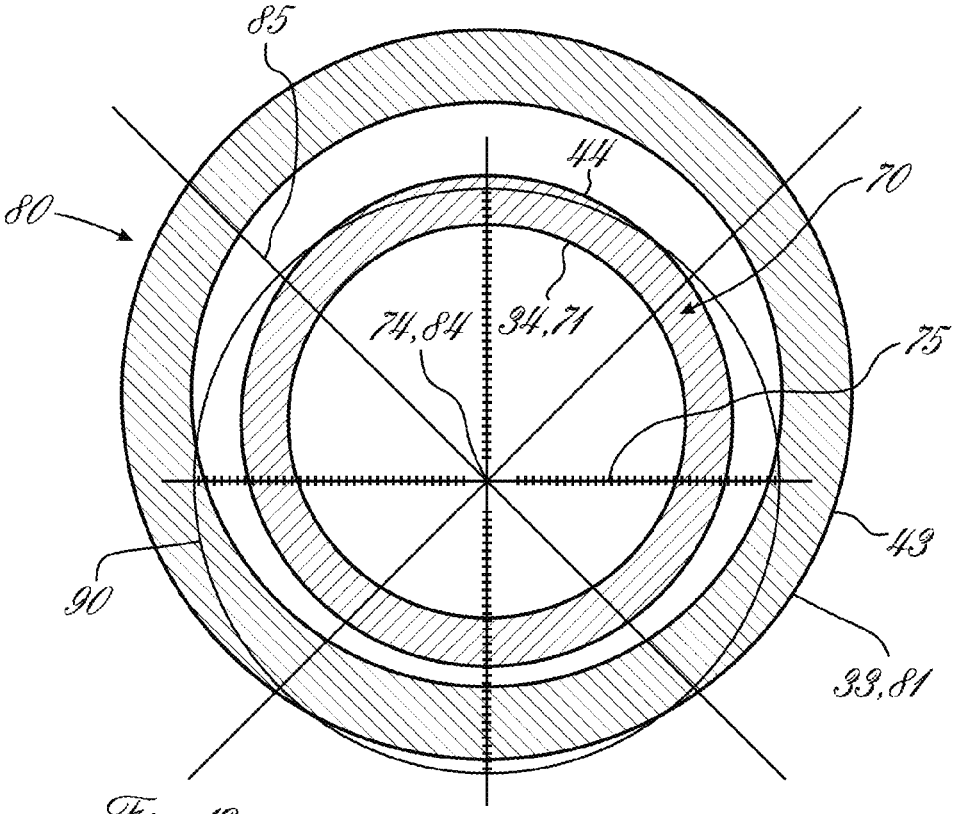
FIG. 12 shows focusing up to the same gray range of the master references, in a schematic view.

In a further exemplary embodiment according to FIG. 11, a similar master reference 80 as the one from the previous exemplary embodiment according to FIG. 10 is provided, wherein the master reference 80 is arranged offset by an angle of 45° as compared with the master reference 70. In the exemplary embodiments according to FIGS. 10 and 11, as well, the reference arms 75, 85 are arranged at a right angle relative to one another.

It is understood that the master references 70, 80 can also be configured in a manner that deviates from this. It is merely advantageous if the master references 70, 80 form some kind of central reference point 74, 84 in terms of their configuration, so that the camera 40 can be placed in a correspondingly simple manner. Preferably, the pass-through of the pass line 30 is depicted by the reference point 74, 84, in each instance, so that operating personnel can obtain an optical impression of the position of the pass line 30.

Furthermore, the circular configuration of a calibration ring 33, 34 offers particularly great precision for the calibration of the camera 40 and of the information technology device 60, because a center point and diameter can be determined particularly well by means of circular shapes.

It would be conceivable, as well, for example, that a reference sensor 71, 81 comprises three or four reference arms 75, 85, which are all jointly oriented at a common central reference point, and thereby each reference arm 75, 85 is also connected with the frame of the dimensional difference at only one location, and specifically no continuous reference arms 75, 85 as on the exemplary embodiments described above are used. Also, the possibility could exist that not only rod-like, long and narrow reference arms 75, 85 are used, as they are used in the exemplary embodiments according to FIGS. 8 to 11, but rather are configured in the most varied manner, as long as they offer the possibility of arranging the camera 40 close to the pass line 30, in an accordingly simple manner.

Because the rolling mills 1 of the present exemplary embodiments are relatively long, the references 44 away from the camera might possibly appear so small for the camera 40 that it cannot detect the references with sufficient accuracy and determine the center point. In these cases, the calibration ring 34 can be enlarged, and thereby more points are available along the calibration ring 34 for determining the center point. The precision can be increased in this way. Because, however, the central reference point 74, 84 is not supposed to be as greatly offset with the enlargement of the calibration ring 34, the positions or orientations of the reference arms 75, 85 can be adapted accordingly, so that the central reference point 74, 84 remains on the pass line 30, if at all possible, or at least close to the pass line. In order for both calibration rings 33, 34 to remain well visible, the size of the other calibration ring 33 should then be adapted accordingly.

In order to set the focus of the camera 40 correctly, in the present exemplary embodiment, before the calibration that corresponds to the first step, the camera 40 is arranged on the reference bracket in a previously defined reference position 41. Subsequently, the lens 48 of the camera 40 is repositioned, in terms of its focus, until the reference sensor 43 close to the camera and the reference sensor 44 away from the camera are imaged with an almost identical blurriness. For this purpose, multiple individual steps take place, as they are shown, for example, in FIGS. 12 to 15.

At first, two master references 70, 80 or calibration (gap) rings 33, 34 are arranged one behind the other from the point of view of the camera 40, wherein a first master reference 80 or a first calibration (gap) ring 33 comprises a reference sensor 81, 43 arranged according to the exemplary embodiment from FIG. 11, and wherein a second master reference 70 or a second calibration (gap) ring 34 comprises a reference sensor 71, 44 configured according to the exemplary embodiment of FIG. 10, so that the first reference sensor 81 is oriented offset by an angle of 45° relative to the second reference sensor 71. In this regard, the master reference 80 represents a reference 43 close to the camera and the master reference 70 represents a reference 44 away from the camera.

The camera 40, with the view at the master references 70, 80, has a virtual cross-hair 90 having a round edging, which is only visible to the camera 40 itself. The virtual cross-hair 90 has a center point and serves for simple rough adjustment of the camera 40. The master references 70, 80 are oriented, in the preceding step, in such a manner that the central reference points 74, 84 lie in the center point of the virtual cross-hair 90. In this manner, the master references 70, 80 and the camera 40 are roughly oriented along a common pass line 30.

In the next step, the focus of the camera 40 and, in particular, the lens 48 are changed until the two master references 70, 80 have approximately the same blurriness for the camera 40. As soon as both master references 70, 80 are represented with equal blurriness to the camera 40, the focus of the camera 40 lies approximately in the center between the two master references 70, 80. Then the focal width of the camera 40 can be used in the best possible manner so as to be able to image the entire region of the rolling mill, in particular between the two master references 70, 80, in the best possible way. In this manner, sufficiently precise focusing of the camera 40 is undertaken.

Figure 13:
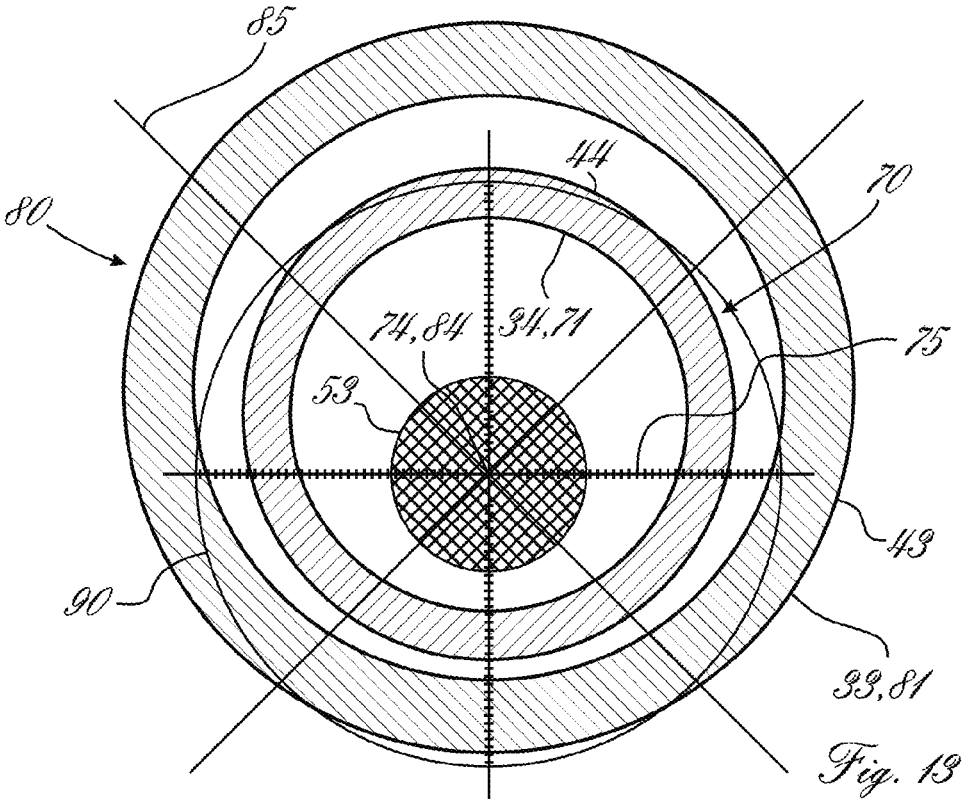
FIG. 13 shows moving the center of the background illumination into the center of the target, in a schematic view.
Figure 14:
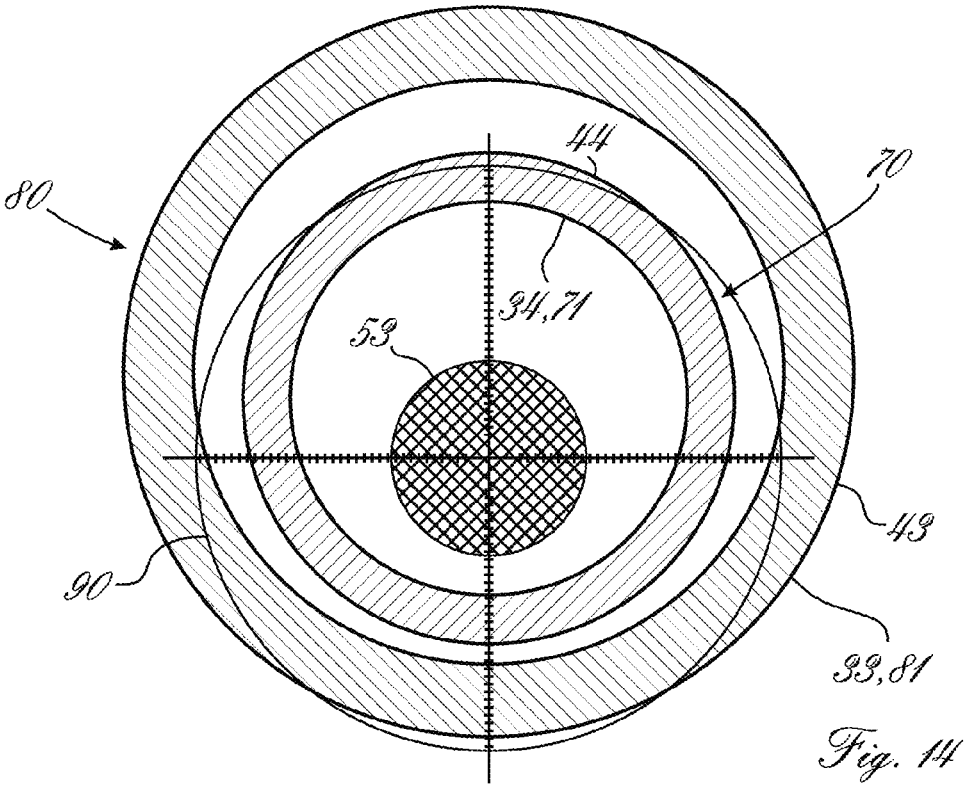
FIG. 14 shows removing the reference sensor from the master references, in a schematic view.
Figure 15:
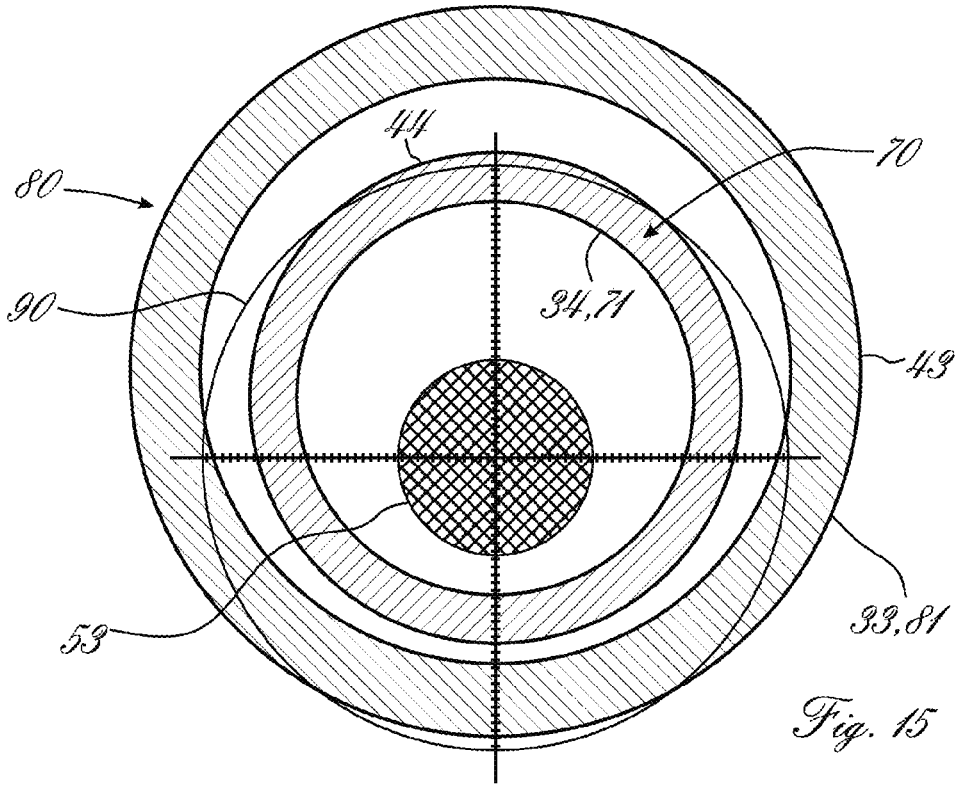
FIG. 15 shows aligning a target on the background illumination, in a schematic view.

In order to also orient the background illumination 50 with the target 53, in accordance with the common pass line 30, in the next step, as it is shown in FIG. 13, the target 53 of the background illumination 50, which target is configured to be circular, is moved at least roughly into the center point of the virtual cross-hair 90. The camera 40 should then image both the calibration rings 33, 34 and the target 53 separately, sufficiently, in each instance.

Now the reference sensors 43, 44 or the master references 70, 80 or the calibration rings 33, 34 can be removed, and the gap measurement can be carried out, making use of the pixel factors and the offset of the pass line with reference to the respective positions of the rolls 14 or guides 21. In this regard, the target 53 helps to calculate possible fluctuations of the camera 40.

Depending on the concrete calibration precision, it is possible to do without the target 53 or the calibration rings 33, 34, wherein for the calibration in the latter case, rolls 14, guides 21 or stand parts of the roll or guide stands 10, 20, for example, can then be used as a reference sensor 43, 44.

In a further exemplary embodiment according to FIG. 16, a rolling or guiding gap of roll stands 10 or of guide stands 20 can be determined in a multi-stand rolling mill 1 having a pass line that reaches through the roll stands 10 or guide stands 20 and serves as a reference for a gap offset. First, a camera 40 is arranged on an input side 11 and a background illumination 50 is arranged on the output side 12, accordingly, and subsequently the roll or guide gap of the stands 10, 20 is determined, making use of an information technology device 60.

In a first step, the camera 40 and the information technology device 60 are calibrated inline with reference to the rolling mill, and in the second step, the camera 40 determines the rolling or guiding gaps inline, making use of the information technology device 60.

In the present exemplary embodiment, the rolling mill 1 comprises two rolling machines 2, which are set directly one behind the other as an overall rolling mill 1. In the present case, for example, a PQF rolling machine is arranged as the first rolling machine 2, close to the camera, and a reduction rolling machine is arranged as the second rolling machine 2, behind the PQF rolling machine from the point of view of the camera 40, away from the camera. It is conceivable that all other known rolling machines 2 can also be combined to form an overall rolling mill 1, such as, for example, an extraction rolling mill.

The pass line 30 in the present exemplary embodiment reaches through both rolling machines 2 of the rolling mill. It is conceivable that the rolling mill 1 also comprises more than two rolling machines 2, wherein then the pass line 30 can also reach through all the rolling machines 2. It is understood that in this regard, partial measurements of individual rolling machines 2 can also be carried out.

In the second step of the present exemplary embodiments according to FIG. 16 as explained above, it is conceivable that subsequently the gap offset from a pass line 30 that correspondingly reaches through the multiple rolling machines 2 is determined as a rolling or guiding gap. By means of individual measurements of the individual rolling machines 2, a more precise measurement can then be carried out, if necessary.

Although only a few embodiments of the present invention have been shown and described, it is to be understood that many changes and modifications may be made thereunto without departing from the spirit and scope of the invention.

| Reference Symbol List: | |
|---|---|
| 1 | rolling mill |
| 2 | rolling machine |
| 10 | roll stand |
| 11 | input side |
| 12 | output side |
| 13 | mandrel bar |
| 14 | roll |
| 20 | guide stand |
| 21 | guide |
| 30 | pass line |
| 33 | calibration ring |
| 34 | calibration ring |
| 40 | camera |
| 41 | reference position of the camera 40 |
| 42 | reference bracket |
| 43 | reference sensor close to the camera |
| 44 | reference sensor away from the camera |
| 45 | reference position |
| 46 | reference scale |
| 47 | reference height |
| 48 | lens |
| 49 | reference stand |
| 50 | background illumination |
| 53 | target |
| 60 | information technology device |
| 61 | measurement direction input possibility |
| 70 | master reference |
| 71 | reference sensor |
| 74 | central reference point |
| 75 | reference arm |
| 80 | master reference |
| 81 | reference sensor |
| 84 | central reference point |
| 85 | reference arm |
| 90 | virtual cross-hair |

What is claimed is:

1. A determination method comprising:

providing a multi-stand rolling mill comprising roll stands having a rolling gap or guide stands having a guiding gap, a pass line that reaches through the roll stands or guide stands that serves as a reference for a gap offset, an input side, and an output side;

arranging a camera at one of the input side and the output side, and arranging a background illumination on another one of the input side and the output side; and subsequently determining the rolling gap or the guiding gap of the stands using an information technology device, by, in a first step, calibrating the camera and the information technology device offline or inline, with reference to the rolling mill, and in a second step, determining the rolling gap or the guiding gap inline, using the camera and the information technology device, wherein for the calibration in the first step, first a master calibration is carried out, then the camera and the background illumination are removed, and afterward a rolling process is carried out, and afterward the camera and the background illumination are arranged on one of the input or output sides again, for an intermediate calibration, and calibrated in the first step, before, in the second step, the camera, making use of the information technology device, determines the rolling or guiding gaps inline once again, wherein during the master calibration, at least two reference scales that are oriented in a linearly independent manner are measured for a reference sensor to be used for intermediate calibrations, and a pixel factor determined from the reference scales is stored in memory in the information technology device, and wherein in the information technology device, the roll stands or guide stands are successively designated based on position along the pass line, and the information technology device stores a measurement direction input option based on placement of the camera at the one of the input side and the output side and of the background illumination at the other of the input side and the output side and a measurement direction is input, and the information technology device assigns potential measurement results to each of the roll stands or guide stands independently of the measurement direction.

2. The determination method according to claim 1, wherein a first reference sensor and a second reference sensor are arranged in the pass line and at least one of the first reference sensor and the second reference sensor is a roll of the roll stands, a guide of the guide stands, a roll stand of the roll stands, a guide stand of of the guide stands, a reference stand, or a calibration ring.

3. The determination method according to claim 2, wherein the first reference sensor comprises a first calibration ring which serves as a first master reference and the second reference sensor comprises a second calibration ring which serves as a second master reference.

4. The determination method according to claim 3, wherein the first calibration ring comprises at least two reference arms and the second calibration ring comprises at least two reference arms.

5. The determination method according to claim 1, wherein in the information technology device, the roll stands or guide stands are designated successively as a function of a rolling direction or wherein a measurement image is mirrored.

6. The determination method according to claim 1, wherein the calibration of the camera and of the information technology device takes place in the first step, using at least one reference sensor close to the camera and at least one reference sensor away from the camera, wherein each of the at least one reference sensor close to the camera and the at least one reference sensor away from the camera is not arranged between the rolls or guides of a first of the stands and the rolls or guides of a last of the stands.

7. The determination method according to claim 1, wherein in the first step, the camera and the information technology device are calibrated offline or inline, with reference to the rolling mill using at least one reference sensor close to the camera and at least one reference sensor away from the camera, wherein each of the at least one reference sensor close to the camera and at least one reference sensor away from the camera is not arranged between the rolls or guides of the first of the stands and the rolls or guides of the last of the stands, wherein in the second step, the camera determines the rolling or guiding gaps inline, making use of the information technology device, wherein (i) before the calibration that corresponds to the first step, first the camera is arranged on a reference holder in a previously defined reference position, and the reference sensor close to the camera and the reference sensor away from the camera are arranged in previously defined reference positions, and then, for the calibration corresponding to the first step, the reference sensor close to the camera and the reference sensor away from the camera are measured using the camera and the information technology device, and subsequently, the pass line or the offset from the pass line or a pixel factor are determined from the measurement result; or (ii) the reference sensor close to the camera and the reference sensor away from the camera are coordinated with one another and with reference to the camera to enable simultaneous detection by the camera of the reference sensor close to the camera and the reference sensor away from the camera; or (iii) before the calibration that corresponds to the first step, the camera is arranged on a reference holder, in a previously defined reference position, and subsequently a lens of the camera is displaced, in terms of focus, until the reference sensor close to the camera and the reference sensor away from the camera are imaged with a matching lack of focus.

8. The determination method according to claim 7, wherein the reference sensor close to the camera or the reference sensor away from the camera is a roll of the roll stands, a guide of the guide stands, or a reference stand.

9. The determination method according to claim 8, wherein the reference sensor close to the camera, the reference sensor away from the camera or the reference stand are brought into a reference position.

10. The determination method according to claim 8, wherein the rolls or guides or correspondingly moved modules of a first and a last of the roll stands are brought into a reference position and are used as a reference close to the camera or a reference away from the camera.

11. The determination method according to claim 7, wherein before the calibration that corresponds to the first step, the camera is arranged on a reference holder, in a previously defined reference position, and subsequently a lens of the camera is displaced, in terms of focus, until the reference sensor close to the camera and the reference sensor away from the camera are imaged with a matching lack of focus, and wherein the lens has a fixed focal width or wherein different lenses (48) are used for different gap sets.

12. The determination method according to claim 7, wherein before the calibration that corresponds to the first step, a target is arranged on a reference holder in a previously defined reference position or wherein a target is coordinated, in terms of target size of the target, with the reference sensor close to the camera and the reference sensor away from the camera, to enable the camera to detect the target, together with the reference sensor close to the camera and the reference sensor away from the camera, at the same time.

13. The determination method according to claim 1, wherein the rolling gap or the guiding gap is determined immediately after a rolling process.

14. The determination method according to claim 1, wherein the rolling gap or the guiding gap is measured in a warm state of the roll stand or of the guide stand.

15. The determination method according to claim 1, wherein a first reference sensor and a second reference sensor are used for intermediate calibrations, wherein for the master calibration, reference positions for the camera and the target together with the background illumination, with reference to the pass line, are established, the position of the pass line with reference to the camera and the target together with the background illumination is stored in memory in the information technology device (60), and at least a first reference scale of the first reference sensor, a second reference scale of the second reference sensor, and first and second pixel factors determined from the first and second reference scales are stored in memory in the information technology device.

16. The determination method according to claim 1, wherein for measuring a first reference scale of the at least two reference scales, a first scale is set at a first reference height previously defined with reference to the pass line, and measured by the camera, making use of an information technology device, and for measuring a second reference scale of the at least two reference scales, a second scale is set at a second reference height previously defined with reference to the pass line, and measured by the camera, making use of the information technology device, wherein the measurement result is stored in memory in the information technology device as a pixel factor.

17. The determination method according to claim 1, wherein only two reference sensors are used for the intermediate calibration.

18. The determination method according to claim 1, further comprising recording at least one of three reference scales, and removing more than two of the stands for the master calibration.

19. The determination method according to claim 1, wherein for establishing the reference positions of the camera and of the target with reference to the pass line, master references are installed in related reference positions, wherein the master references are detectable by the camera and the information technology device.

20. The determination method according to claim 1, wherein for establishing the reference positions of the camera or the target with reference to the pass line, the position of the camera or of the target is varied or wherein the detected position of the master references is stored in memory in the information technology device as a position of the pass line.

21. The determination method according to claim 1, wherein the camera records multiple images during a measurement and compares them with one another.

22. The determination method according to claim 1, wherein filters used for the camera are changed during the measurement.

23. The determination method according to claim 1, wherein in the second step, only a gap form of the rolling gap or the guiding gap is determined as the rolling gap or the guiding gap is determined.

24. The determination method according to claim 1, wherein the rolling mill comprises at least two rolling machines and in the second step, only the gap offset relative to the pass line that reaches through the at least two rolling machines is determined as the rolling gap or the guiding gap.

25. The determination method according to claim 1, wherein a first reference sensor and a second reference sensor are arranged in the pass line, and in the first step, a position of the camera or of a target are changed to enable the camera to detect separately the first and second reference sensors or the target.

26. The determination method according to claim 1, wherein for the master calibration, master references are installed on the pass line, and the camera, and the background illumination and a target are oriented with reference to the pass line defined using the master references or the position of the pass line is measured accordingly, with reference to the camera or the target, and stored in memory in the information technology device, while for the intermediate calibration, no use of the master references is made.

27. The determination method according to claim 1, wherein for the master calibration, at least three reference scales are recorded offline, at reference heights previously defined with reference to the pass line, or inline in the case of at least one stand removed from the rolling mill, and a pixel factor determined from the reference scales is stored in memory in the information technology device.

28. The determination method according to claim 1, wherein first and second references are used for intermediate calibrations, wherein for the master calibration, reference positions for the camera and a target are established with reference to the pass line, the position of the pass line with reference to the camera and the target is stored in memory in the information technology device, and at least a first reference scale of the first reference and a second reference scale of the second reference are measured, and a pixel factor determined from the reference scales is stored in memory in the information technology device.

29. The determination method according to claim 1, wherein the intermediate calibration is used as a calibration in the first step of the determination method.

30. A determination method comprising:

providing a multi-stand rolling mill comprising roll stands having a rolling gap or guide stands having a guiding gap, a pass line that reaches through the roll stands or guide stands that serves as a reference for a gap offset, an input side, and an output side;

arranging a camera at one of the input side and the output side, and arranging a background illumination on an other one of the input side and the output side; and subsequently determining the rolling gap or the guiding gap of the stands using an information technology device, by, in a first step, calibrating the camera and the information technology device offline or inline, with reference to the rolling mill, and in a second step, determining the rolling gap or the guiding gap inline, using the camera and the information technology device, wherein (i) in the second step, only a gap form of the rolling gap or the guiding gap is determined as the rolling gap or the guiding gap is determined; or (ii) the rolling mill comprises at least two rolling machines and in the second step, only the gap offset relative to the pass line that reaches through the at least two rolling machines is determined as the rolling gap or the guiding gap; or (iii) in the information technology device, the roll stands or guide stands are successively designated based on position along the pass line, and the information technology device stores a measurement direction input option based on placement of the camera at the one of the input side and the output side and of the background illumination at the other of the input side and the output side and a measurement direction is input, and the information technology device assigns potential measurement results to each of the roll stands or guide stands independently of the measurement direction; or (iv) a first reference sensor and a second reference sensor are arranged in the pass line and in the first step, a position of the camera or of a target are changed to enable the camera to detect separately the first and second reference sensors or the target, wherein for the calibration in the first step, first a master calibration is carried out, then the camera and the background illumination are removed, and afterward a rolling process is carried out, and afterward the camera and the background illumination are arranged on one of the input or output sides again, for an intermediate calibration, and calibrated in the first step, before, in the second step, the camera, making use of the information technology device, determines the rolling or guiding gaps inline once again, wherein during the master calibration, at least two reference scales that are oriented in a linearly independent manner are measured for a reference sensor to be used for intermediate calibrations, and a pixel factor determined from the reference scales is stored in memory in the information technology device.

31. The determination method according to claim 30, wherein during the master calibration, at least one reference offset of a reference sensor to be used for intermediate calibrations is measured and stored in memory in the information technology device.

* * * * *